US012790933B2

(12) United States Patent
Hopwood et al.

(10) Patent No.: US 12,790,933 B2
(45) Date of Patent: Nov. 10, 2026

(54) SYSTEMS AND METHODS FOR IMPROVED WEIGHT-ON-BIT ACCURACY DURING DRILLING

(71) Applicant: Helmerich & Payne Technologies, LLC, Tulsa, OK (US)

(72) Inventors: Fergus Hopwood, Whitefish, MT (US); Richard Kulavik, Frisco, TX (US)

(73) Assignee: Helmerich & Payne Technologies, LLC, Tulsa, OK (US)

( * ) Notice: Subject to any disclaimer, the term of this patent is extended or adjusted under 35 U.S.C. 154(b) by 0 days.

(21) Appl. No.: 18/821,852

(22) Filed: Aug. 30, 2024

(65) Prior Publication Data

US 2026/0063024 A1 Mar. 5, 2026

(51) Int. Cl.

| | |
|---|---|
| ***E21B 44/00*** | (2006.01) |
| ***E21B 3/02*** | (2006.01) |
| ***E21B 19/00*** | (2006.01) |
| ***E21B 33/08*** | (2006.01) |
| ***E21B 47/024*** | (2006.01) |

(52) U.S. Cl.

CPC ..... *E21B 44/00* (2013.01); *E21B 3/022* (2020.05); *E21B 19/008* (2013.01); *E21B 33/085* (2013.01); *E21B 47/024* (2013.01)

(58) Field of Classification Search

CPC ..... E21B 44/00; E21B 3/022; E21B 19/008; E21B 33/085; E21B 47/024

See application file for complete search history.

(56) References Cited

U.S. PATENT DOCUMENTS

| | | | | |
|---|---|---|---|---|
| 6,039,130 | A * | 3/2000 | Pruet | E21B 17/16 175/325.1 |
| 10,876,390 | B1 | 12/2020 | Scotvold et al. | |
| 10,957,177 | B2 | 3/2021 | Michalopulos et al. | |
| 10,982,950 | B2 | 4/2021 | Torrione | |
| 2010/0187008 | A1* | 7/2010 | Wassermann | E21B 47/024 175/45 |
| 2016/0130889 | A1 | 5/2016 | Torrione | |
| 2021/0324700 | A1* | 10/2021 | McGuire | E21B 47/09 |
| 2023/0114148 | A1 | 4/2023 | Whitlow et al. | |

* cited by examiner

*Primary Examiner* — Dany E Akakpo

(74) *Attorney, Agent, or Firm* — Kilpatrick Townsend & Stockton LLP

(57) ABSTRACT

Drilling systems and methods determine a compensated SWOB that accounts for forces applied by a rotating control device. A method of drilling a borehole includes tracking movement of a drill string relative to a rotating control device (RCD) and determining a compensated SWOB that accounts for passage of a tool joint through the RCD. The compensated SWOB is based on a difference between a weight of the drill string and the hook load minus an axial resistance force during passage of a tool joint through the RCD.

30 Claims, 19 Drawing Sheets

SYSTEMS AND METHODS FOR IMPROVED WEIGHT-ON-BIT ACCURACY DURING DRILLING

BACKGROUND

Drilling a borehole for the extraction of minerals has become an increasingly complicated operation due to the increased depth and complexity of many boreholes, including the complexity added by directional drilling. Drilling is an expensive operation and errors in drilling add to the cost and, in some cases, drilling errors may permanently lower the output of a well for years into the future. Conventional technologies and methods may not adequately address the complicated nature of drilling, and may not be capable of gathering and processing various information from downhole sensors and surface control systems in a timely manner, in order to improve drilling operations and minimize drilling errors.

BRIEF SUMMARY

The following presents a simplified summary of embodiments of the invention in order to provide a basic understanding of the invention. This summary is not an extensive overview of the invention. It is not intended to identify key/critical elements of the invention or to delineate the scope of the invention. Its sole purpose is to present embodiments of the invention in a simplified form as a prelude to the more detailed description that is presented later.

In many drilling systems, a drill string is rotated and advanced into the borehole by a drilling rig to drill the borehole. The drill string can be formed by drill pipes that are connected by tool joints. Each of the drill pipes can have any suitable length such as, for example, approximately 30 feet in some instances. A bottom hole assembly (BHA) is typically attached to the distal end of the drill string. The BHA typically includes a drill bit for drilling of the borehole. The drilling rig can include a top drive that is attachable to the top end of the drill string and operable to rotate the drill string. The drill rig can include a hoisting system (such as a drilling drawworks) operable to selectively lower the top drive to advance the drill string into the borehole and selectively raise the top drive to accommodate the addition of another drill pipe or to lift the drill string upward out of the borehole. The drill rig can include a rotating control device configured to block escape of fluid (e.g., natural gas, oil) from the borehole through an open annular space surrounding the drill string. The rotating control device can include a rotating seal with a central aperture through which the drill string extends. The rotating seal rotates with the drill string and blocks the annular space surrounding the drill string.

The amount of force applied to the drill bit by the drill string is typically referred to as "weight-on-bit" (WOB). WOB is typically controlled in an attempt to optimize drilling performance. Drilling using WOB that is less than an optimum WOB typically produces a lower rate of penetration (ROP) as compared to drilling with the optimum WOB. Drilling using WOB that is greater than the optimum WOB may result in damage to the drill bit, the BHA, and/or the drill string. For example, in some instances, drilling using WOB that is greater than the optimum WOB may result in detrimental stick/slip oscillations of the drill string that cause damage.

Although WOB can be directly measured via a suitably instrumented BHA, surface weight-on-bit (SWOB) may be used in place of downhole measured WOB. SWOB is defined as the difference between the free-hanging weight (i.e., off bottom) of the drill string (which can include the weight of the BHA) and the vertical support load (aka "hook load") applied to the top drive by the hoisting system. The free-hanging weight of the drill string can be determined by accounting for the number of the drill pipes and tool joints in the drill string. For a vertical borehole, SWOB may provide a relatively accurate estimate of WOB.

SWOB may, however, deviate substantially from WOB in certain circumstances. For example, for non-vertical boreholes produced via directional drilling, downhole contact forces and downhole frictional forces applied to the drill string may result in a deviation between SWOB and WOB. As another example, passage of each of the tool joints of the drill string through the rotating seal of the rotating control device will typically produce a substantial intermittent reduction in the hook load because more force is required to push the tool joint (which has a larger diameter than the main body of a tool pipe) through the rotating seal as compared to the force required to push the main body of a tool pipe through the rotating seal. The reductions in the hook load result in substantial perceived increases in SWOB. Subsequently, when the pipe join exits the RCD there is a perceived decrease in SWOB. Some systems address this perceived change in WOB by adjusting the WOB setpoints of a drilling control system. In one such system, the WOB setpoint is adjusted when the pipe joint is determined to enter the RCD, and then re-adjusted when the pipe joint is determined to have exited the RCD. Such a system is described in U.S. Pat. No. 10,876,390 B1, issued on Dec. 29, 2020, and titled "Method of Controlling a Drilling Operation, and Rotating Control Device Mitigator," which is hereby incorporated by reference as if fully set forth herein.

Embodiments of the present disclosure include drilling systems and methods that determine a compensated surface weight-on-bit that compensates for the substantial intermittent reductions in hook load caused by the passage of the tool joints through the rotating seal of the rotating control device. The compensated SWOB can also account for additional factors that may produce deviation between SWOB and WOB such as, but not limited to, the combined weight of the traveling block and top drive, forces applied by the drag chains, drill pipe buoyancy effects, and forces applied by the drilling mud hose. Operation of the drilling system during drilling of a borehole can be controlled based at least in part on the compensated SWOB. In embodiments, the compensated SWOB is used as a control parameter for use in controlling the hoisting system to optimize drilling of a borehole.

The drilling system and methods described herein provide numerous benefits. One substantial benefit is decreased deviation between the compensated SWOB and WOB. In contrast, in some existing approaches in which SWOB is calculated based on hook load and drill string weight without accounting for the intermittent axial force applied to the drill string by the rotating control device, the resulting intermittent changes in measured hook load result in corresponding intermittent artificial increases in SWOB. By accounting for the intermittent axial forces applied to the drill string by the RCD during passage of the tool joints in the determination of the compensated SWOB, artificial deviations between the compensated SWOB and WOB may be greatly reduced, thereby making the compensated SWOB a more accurate surrogate for WOB for use in controlling drilling operations. In embodiments, a force defined by an axial resistance force profile is used to account for the force applied by the RCD to the tool joint during passage of the tool joint through the RCD. The force defined by the axial resistance force profile varies over a length of travel of the tool joint through the RCD. The use of the axial resistance force profile provides for increase accuracy in accounting for the variation in the force applied to the tool joint by the RCD over the length of travel of the tool joint through the RCD. Thus, it will be apparent that determining and using a WOB value that compensates for, among many other things, the added resistance of the RCD as described in more detail below is quite different, and functions in a substantially different way and gets a substantially different result, than changing a WOB setpoint and then re-adjusting the setpoint to address a pipe joint moving through an RCD.

The compensated SWOB may be utilized by one or more systems used on the drilling rig for controlling various drilling parameters (e.g. ROP, WOB setpoint, etc.). By improving the accuracy of the SWOB used to determine drilling parameters, the efficiency, cost, and accuracy of drilling the wellbore may be improved. The drilling system and methods described herein can also be employed in conjunction with many operational modes (e.g., autodriller system on or off, without an autodriller system, with autoslide system on or off, without an autoslide system, etc.). In other words, the systems and methods used herein may not require switching between an and off settings for systems such as autodriller systems or autoslide systems. For example, no setpoint adjustment may be needed for other systems (autoslide, autodriller, DAS, etc.) which can simplify and improve the performance of the drilling system.

Thus, in one aspect, a drilling system includes one or more sensors and a computer system. The one or more sensors are configured to generate sensor output indicative of a hook load applied by a hoisting system to a drill string located in a borehole being drilled. The computer system is coupled to the one or more sensors. The computer system is configured to monitor the hook load and track movement of a drill string relative to a rotating control device (RCD). The drill string includes drill pipes and tool joints. Each of the tool joints connects two of the drill pipes. The computer system is configured to determine a compensated SWOB that accounts for passage of a tool joint through the RCD. The compensated SWOB is based on a difference between a weight of the drill string and the hook load minus an axial resistance force when a tool joint passes through the RCD.

In some embodiments, the operation of the hoisting system is controlled by the computer system further based on a rate of descent of the drill string and a limit for the rate of descent of the drill string. In some embodiments, the computer system is further configured to control the hoisting system further based on the rate of descent of the drill string during passage of each tool joint through the RCD.

In some embodiments, the computer system is further configured to repeatedly determine an uncompensated SWOB based on a difference between a weight of the drill string and the hook load. The axial resistance force can be based on measured variations in the uncompensated SWOB during passage of prior tool joints through one or more rotating control devices. In some embodiments, the borehole is drilled over a drilling time span. The computer system can be configured to generate uncompensated SWOB data indicative of the uncompensated SWOB over the drilling time span, process the uncompensated SWOB data to determine RCD passage data indicative of variations in the uncompensated SWOB induced by passage of the tool joints through the RCD, and the axial resistance force is at least partially based on the RCD passage data. In some embodiments, the computer system is configured to process the RCD passage data to calculate a running average axial resistance force from a running average of the RCD passage data for the passage of two or more of the tool joints through the RCD. The axial resistance force can be at least partially based on the running average axial resistance force. In some embodiments, the computer system is configured to process the uncompensated SWOB data to track a number of the drill pipes that are downhole and determine the weight of the drill string based on the number of the drill pipes that are downhole. With this system, a count can be kept of the number of times the WOB has been compensated by an amount corresponding to a pipe joint entering the RCD. This count can be used to automatically generate a pipe tally, which can be used in connection with determining measured depth, WOB, and other drilling parameters. The rig control systems can use this pipe tally to cross-check other pipe tallies which may be automatically generated by other rig systems during drilling and, if a discrepancy between the tallies is detected, an alert or warning may be generated, such as with a visual or audio alarm, or by automatically sending one or more text messages, voice messages, and/or emails.

In some embodiments, the computer system is configured to process image data produced by a machine-vision imaging device to determine when the tool joint is entering the RCD and/or exiting the RCD. In some embodiments, a first machine-vision imaging device is used to generate first image data that is processed to determine when the tool joint is entering the RCD and a second machine-vision imaging device is used to generate second image data that is processed to determine when the tool joint is entering the RCD.

In some embodiments, the computer system is configured to monitor the hook load to detect engagement of a tool joint with the RCD. For example, in some embodiments, the computer system is configured to monitor a rate of descent of the drill string and detect an engagement of the rotating control device by the tool joint based on the rate of descent of the drill string and a detected variation in the hook load.

In some embodiments, the computer system is further configured to determine weight-on-bit based on a track of the borehole. For example, in some embodiments, the computer system is configured to: (a) determine a set of down-hole contact forces for producing a deflected shape of the drill string that conforms to a track of a borehole in which the drill string is disposed, (b) determine weight-on-bit (WOB) based on the compensated SWOB and the set of down-hole contact forces, and (c) control operation of the top drive and/or the hoisting system to drill a portion of the borehole based on the WOB and/or a rate of descent of the drill string. In some embodiment, the drill string includes a bottom hole assembly (BHA) that includes one or more BHA sensors configured to generate BHA sensor output indicative of position and orientation of the BHA and the computer system is configured to process the BHA sensor output to determine the track of the borehole. In some embodiments, the computer system is configured to calculate down-hole friction forces applied to the drill string based on the set of down-hole contact forces. In some embodiments, the computer system is configured to calculate the set of down-hole contact forces applied to the drill string using a physics-informed neural network (PINN) model.

In some embodiments, the computer system is further configured to account for multiple configurations of tool joints in the determination of the compensated SWOB. For example, in some embodiments, the computer system is configured to: (a) store a first tool joint configuration axial resistance force for a first tool joint configuration of the tool joints, (b) store a second tool joint configuration axial resistance force for a second tool joint configuration of the tool joints, (c) set the axial resistance force equal to the first tool joint configuration axial resistance force for determining the compensated SWOB when the tool joint passing through the RCD has the first tool joint configuration, and (d) set the axial resistance force equal to the second tool joint configuration axial resistance force for determining the compensated SWOB when the tool joint passing through the RCD has the second tool joint configuration. In some embodiments, the computer system is configured to process image data produced by a machine-vision imaging device to determine whether the tool joint passing through the RCD has the first tool joint configuration or the second tool joint configuration.

In another aspect, a method of drilling a borehole employs a compensated SWOB to control drilling of the borehole. The method includes generating, by one or more sensors, sensor output indicative of a hook load applied to a top drive by a hoisting system. The method includes repeatedly processing, by a computer system, the sensor output to monitor the hook load. The method includes tracking, by the computer system, movement of a drill string relative to a rotating control device (RCD). The drill string includes drill pipes and tool joints. Each of the tool joints connects two of the drill pipes. The method includes repeatedly determining, by the computer system, a compensated SWOB that accounts for passage of the tool joints through the RCD. The compensated SWOB is based on a difference between a weight of the drill string and the hook load minus an axial resistance force during passage of the tool joint through the RCD. The axial resistance force can vary over a length of travel of the tool joint through the RCD. The method includes controlling, by the computer system, operation of a top drive and the hoisting system to drill a borehole. The operation of the hoisting system is controlled using the compensated SWOB.

In some embodiments of the method, the controlling operation of the hoisting system by the computer system is further based on a rate of descent of the drill string and a limit for the rate of descent of the drill string. In some embodiments of the method, the computer system controls operation of the hoisting system during the passage of each tool joint through the RCD based on a rate of descent of the drill string and a limit for the rate of descent of the drill string.

In some embodiments, the method further includes repeatedly determining, by the computer system, an uncompensated SWOB based on a difference between a weight of the drill string and the hook load. In some embodiments of the method, the axial resistance force is based on measured variations in the uncompensated SWOB during passage of prior tool joints through one or more rotating control devices. In some embodiments, the method further includes: (a) generating, by the computer system, SWOB data indicative of the SWOB over a drilling time span, and (b) processing, by the computer system, the SWOB data to determine RCD passage data indicative of variations in the SWOB induced by passage of the tool joints through the RCD. The axial resistance force can be at least partially based on the RCD passage data. In some embodiments, the method further includes processing, by the computer system, the RCD passage data to calculate a running average axial resistance force from a running average of the RCD passage data for the passage of two or more of the tool joints through the RCD. The axial resistance force can be at least partially based on the running average axial resistance force. In some embodiments, the method further includes:

(a) processing, by the computer system, the SWOB data to track a number of the drill pipes that are downhole, and (b) determining, by the computer system, the weight of the drill string based on the number of the drill pipes that are downhole.

In some embodiments of the method, machine vision is used to track the movement of the drill string relative to the RCD. For example, in some embodiments, the method further includes processing, by the computer system, image data produced by a machine-vision imaging device to determine when the tool joint is entering the RCD and/or exiting the RCD.

In some embodiments of the method, the hook load is monitored to detect engagements of the RCD by the tool joints. For example, in some embodiments, the method includes: (a) monitoring, by the computer system, a rate of descent of the drill string, and (b) detecting, by the computer system, an engagement of the rotating control device by the tool joint based on the rate of descent of the drill string and a detected variation in the hook load.

In some embodiments, the method includes determining downhole WOB accounting for the track of the borehole. For example, in some embodiments, the method includes: (a) determining, by the computer system, a set of down-hole contact forces for producing a deflected shape of the drill string that conforms to a track of a borehole in which the drill string is disposed, (b) determining, by the computer system, weight-on-bit (WOB) based on the compensated SWOB and the set of down-hole contact forces, and (c) controlling, by the computer system, operation of the top drive and/or the hoisting system to drill a portion of the borehole based on the WOB and/or a rate of descent of the drill string. The drill string can include a bottom hole assembly (BHA) that includes one or more BHA sensors configured to generate BHA sensor output indicative of position and orientation of the BHA. In some embodiments, the method further includes processing the BHA sensor output by the computer system to determine the track of the borehole. In some embodiments, the method includes calculating, by the computer system, down-hole friction forces applied to the drill string based on the set of down-hole contact forces. In some embodiments of the method, the computer system calculates the set of down-hole contact forces applied to the drill string using a physics-informed neural network (PINN) model.

In some embodiments of the method, the computer system is configured to determine the compensated SWOB accounting for multiple configurations of the tool joints. For example, in some embodiments, the method includes: (a) storing, by the computer system, a first tool joint configuration axial resistance force for a first tool joint configuration of the tool joints, (b) storing, by the computer system, a second tool joint configuration axial resistance force for a second tool joint configuration of the tool joints, (c) setting, by the computer system, the axial resistance force equal to the first tool joint configuration axial resistance force for determining the compensated SWOB when the tool joint passing through the RCD has the first tool joint configuration, and (d) setting, by the computer system, the axial resistance force equal to the second tool joint configuration axial resistance force for determining the compensated SWOB when the tool joint passing through the RCD has the second tool joint configuration. In some embodiments, the method further includes processing, by the computer system, image data produced by a machine-vision imaging device to determine whether the tool joint passing through the RCD has the first tool joint configuration or the second tool joint configuration.

For a fuller understanding of the nature and advantages of the present invention, reference should be made to the ensuing detailed description and accompanying drawings.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

Figure 1:
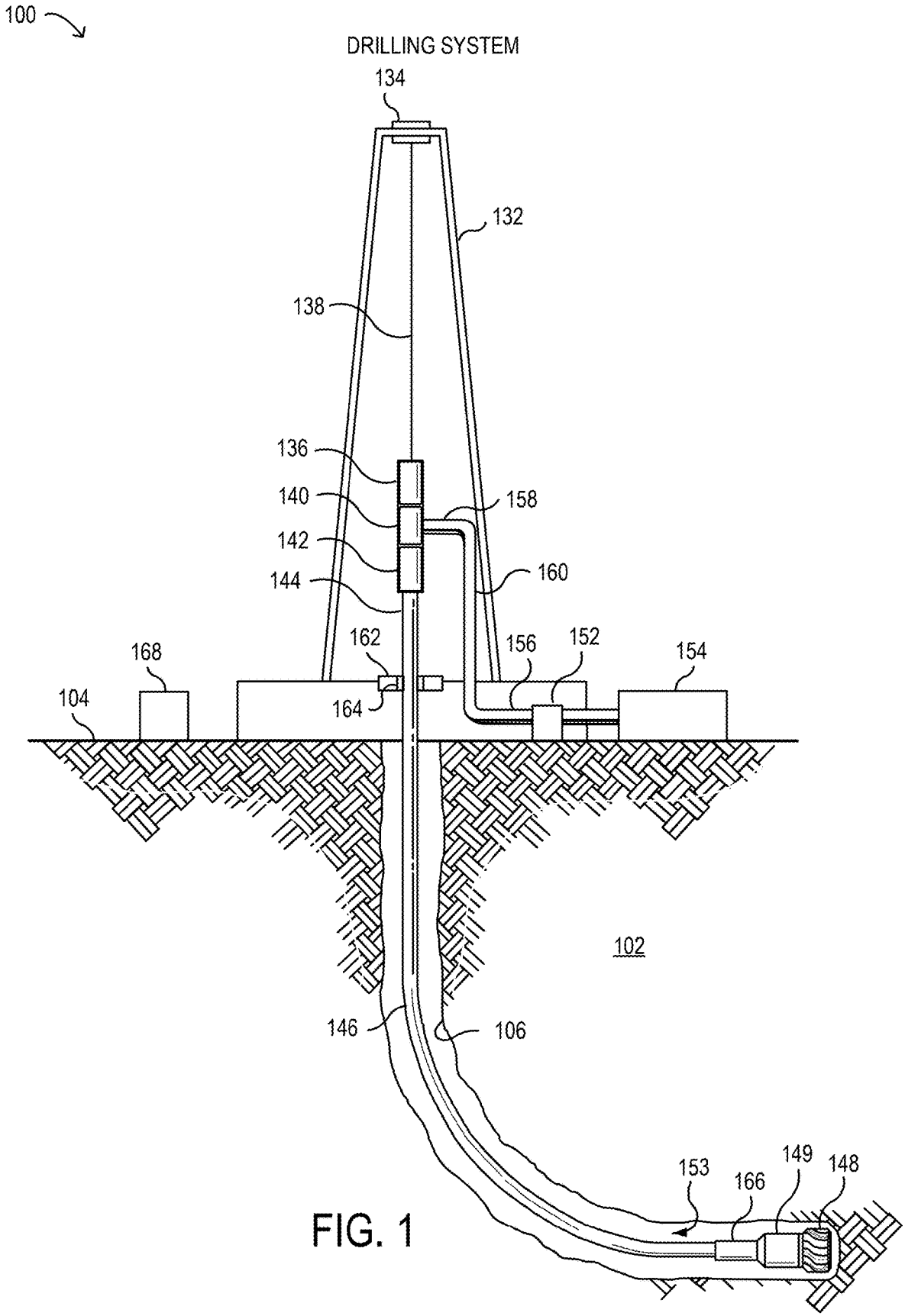
FIG. 1 illustrates a drilling system for drilling a borehole, in accordance with embodiments.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

In many drilling systems, a drilling rig is used to rotate and advance a drill string and bottom hole assembly to drill a borehole. The BHA includes a drill bit that is rotated and advanced through the geological formation(s) being drilled. The drill string is typically formed by drill pipes that are sequentially coupled via tool joints. The drilling rig typically includes a top drive that is couplable to the top of the drill string and operable to rotate the drill string to rotate the BHA. The drill rig typically includes a hoisting system operable to lower the top drive to advance the drill string and BHA into the borehole. The hoisting system is also operable to raise the top drive to accommodate adding drill pipes to the drill string or to retract the drill string and BHA from the borehole.

The drill string typically extends through a rotating control device, which includes a rotating seal configured to prevent escape of fluid from the borehole. The drill pipes are typically coupled via tool joints that have a larger outer diameter than the rest of the drill pipe. When a tool joint passes downwardly through the rotating seal, the rotating seal applies an upwardly directed force onto the drill string, which results in a reduction in a vertical support load applied to the drill string. The reduction in the vertical support load applied to the drill string may be mistakenly interpreted as arising from increased weight-on-bit (WOB), which may cause an operator of the drilling system to increase the vertical support load applied to the drill string, thereby resulting in a reduction of the actual WOB, which typically reduces the rate at which the borehole is formed, thereby increasing the time required to drill the bore hole and therefore the total cost of drilling the borehole. In some embodiments, the variation in load applied to the drill string by the rotating seal of the rotating control device is accounted for in determining a calculated WOB for use in controlling operation of the drilling rig.

Referring now to the drawings, FIG. 1 illustrate a drilling system 100, in accordance with embodiments. The drilling system 100 is one example of a top drive drilling system. The drilling system 100 includes a derrick 132 disposed on a ground surface 104. The drilling system 100 is configured for drilling a borehole 106 into the earth. Typically the drilling system 100 is used to drill the borehole 106 into a geological formation of interest.

The derrick 132 includes a crown block 134, a traveling block 136, and a drilling line 138. The traveling block 136 is supported from the crown block 134 by the drilling line 138. The drilling system 100 includes a top drive 140, a saver sub 142, and a drill pipe 144, which is part of a drill string 146. The top drive 140 is coupled to the traveling block 136. The top drive 140 is configured to rotate the drill pipe 144 to rotate the drill string 146. In the illustrated embodiment, the saver sub 142 is disposed between the top drive 140 and the drill pipe 144. The top drive 140 may rotate the drill string 146 via the saver sub 142. The drill string 146 is attached to a bottom hole assembly (BHA) 149. The BHA 149 includes a drill bit 148. Rotation of the drill string 146 by the top drive 140 rotates the BHA 149 and the drill bit 148, which can be used to drill a borehole 106 through a geological formation 102. The drilling system 100 includes a rotating control device 162 that included a rotating seal 164 that sealing engages the drill string 146 to inhibit escape of fluid from the borehole.

The drilling system includes a mud pump 152 that is operable to direct a fluid mixture (e.g., drilling mud 153) from a mud pit 154 into the drill string 146. The mud pit 154 is shown schematically as a container, but it is noted that various receptacles, tanks, pits, or other containers may be used. The drilling mud 153 may flow from mud pump 152 into a discharge line 156 that is coupled to a rotary hose 158 by a standpipe 160. The rotary hose 158 may then be coupled to the top drive 140, which includes a passage for the drilling mud 153 to flow into the borehole 106 via the drill string 146 from which the drilling mud 153 may emerge at the drill bit 148. The drilling mud 153 may lubricate the drill bit 148 during drilling and, due to the pressure supplied by the mud pump 152, the drilling mud 153 may return via the borehole 106 to the surface 104.

In the drilling system 100, drilling equipment (see also FIG. 5) is used to perform the drilling of the borehole 106, such as the top drive 140 (or rotary drive equipment) that couples to the drill string 146 and the BHA 149 and is configured to rotate the drill string 146 and apply pressure to the drill bit 148. The drilling system 100 may include control systems such as a weight on bit (WOB)/differential pressure control system 522, a positional/rotary control system 524, a fluid circulation control system 526, and a sensor system 528, as further described below with respect to FIG. 5. The control systems may be used to monitor and change drilling rig settings, such as the WOB or differential pressure to alter the rate of penetration (ROP) or the radial orientation of the tool face, change the flow rate of drilling mud, and perform other operations. The sensor system 528 may be for obtaining sensor data about the drilling operation and drilling system 100, including the downhole equipment. For example, the sensor system 528 may include measurement while drilling (MWD) tools and/or logging while drilling (LWD) tools for acquiring information, such as tool face orientation and formation logging information, that may be saved for later retrieval, transmitted with or without a delay using any of various communication means (e.g., wireless, wireline, or mud pulse telemetry), or otherwise transferred to a steering control system 168 of the drilling system 100. As used herein, an MWD tool is enabled to communicate downhole measurements without substantial delay to the surface 104, such as using mud pulse telemetry, while a LWD tool is equipped with an internal memory that stores measurements when downhole and can be used to download a stored log of measurements when the LWD tool is at the surface 104. The internal memory in the LWD tool may be a removable memory, such as a universal serial bus (USB) memory device or another removable memory device. Certain downhole tools may have both MWD and LWD capabilities. Information acquired by the sensor system 528 may include information related to hole depth, bit depth, inclination angle, azimuth angle, true vertical depth, gamma count, standpipe pressure, mud flow rate, rotations per minute (RPM), bit speed, ROP, WOB, among other information. All or part of the sensor system 528 may be incorporated into a control system, or in another component of the drilling equipment. The drilling system 100 can be configured in many different implementations in which different control systems and subsystems may be used.

Sensing, detection, measurement, evaluation, storage, alarm, and other functionality may be incorporated into a downhole tool 166 or the BHA 149 or elsewhere along the drill string 146 to provide downhole surveys of the borehole 106. Accordingly, the downhole tool 166 may be an MWD tool or a LWD tool or both, and may accordingly utilize connectivity to the surface 104, local storage, or both. In different implementations, gamma radiation sensors, magnetometers, accelerometers, and other types of sensors may be used for the downhole surveys. Although the downhole tool 166 is shown in singular in the drilling system 100, it is noted that multiple instances (not shown) of the downhole tool 166 may be located at one or more locations along the drill string 146.

In some embodiments, formation detection and evaluation functionality may be provided via the steering control system 168 on the surface 104. The steering control system 168 may be located in proximity to the derrick 132 or may be otherwise included with the drilling system 100. In other embodiments, the steering control system 168 may be remote from the actual location of the borehole 106 (see also FIG. 4). For example, the steering control system 168 may be a stand-alone system or may be incorporated into other systems included with the drilling system 100.

In operation, the steering control system 168 may be accessible via a communication network and may accordingly receive formation information via the communication network. In some embodiments, the steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using certain methods and systems for improved drilling performance.

In particular embodiments, at least a portion of the steering control system 168 may be located in the downhole tool 166 (not shown). In some embodiments, the steering control system 168 may communicate with a separate controller (not shown) located in the downhole tool 166. In particular, the steering control system 168 may receive and process measurements received from downhole surveys and may perform the calculations using the downhole surveys and other information referenced herein.

In the drilling system 100, to aid in the drilling process, data is collected from within the borehole 106, such as from sensors in the BHA 149, sensors in the downhole tool 166, or both. The collected data may include geological characteristics of the formation 102 in which the borehole 106 was formed, attributes of the drilling system 100, including the BHA 149, and drilling information such as weight-on-bit (WOB), drilling speed, and other information pertinent to the formation of the borehole 106. The drilling information may be associated with a particular depth or another identifiable marker to index the collected data. For example, the collected data for the borehole 106 may capture drilling information indicating that drilling of the well from 1,000 feet to 1,200 feet occurred at a first rate of penetration (ROP) through a first rock layer with a first WOB, while drilling from 1,200 feet to 1,500 feet occurred at a second ROP through a second rock layer with a second WOB (see also FIG. 2). In some applications, the collected data may be used to virtually recreate the drilling process that created the borehole 106 in the formation 102, such as by displaying a computer simulation of the drilling process. The accuracy with which the drilling process can be recreated depends on a level of detail and accuracy of the collected data, including collected data from a downhole survey of the well trajectory.

The collected data may be stored in a database that is accessible via a communication network for example. In some embodiments, the database storing the collected data for the borehole 106 may be located locally at the drilling system 100, at a drilling hub that supports a plurality of the drilling systems 100 in a region, or at a database server accessible over a communication network that provides access to the database (see also FIG. 4). At the drilling system 100, the collected data may be stored at the surface 104 or downhole in the drill string 146, such as in a memory device included with the BHA 149. Alternatively, at least a portion of the collected data may be stored on a removable storage medium, such as at the steering control system 168 or the BHA 149, which is later coupled to the database in order to transfer the collected data to the database, which may be manually performed at certain intervals, for example.

In FIG. 1, the steering control system 168 is located at or near the surface 104 from where borehole 106 is being drilled. The steering control system 168 may be coupled to equipment used in drilling system 100 and may also be coupled to the database, whether the database is physically located locally, regionally, or centrally (see also FIG. 4 and FIG. 5). Accordingly, the steering control system 168 may collect and record various inputs, such as measurement data from a magnetometer and an accelerometer that may also be included with the BHA 149.

The steering control system 168 may further be used as a surface steerable system, along with the database, as described above. The surface steerable system may enable an operator to plan and control drilling operations while drilling is being performed. The surface steerable system may itself also be used to perform certain drilling operations, such as controlling certain control systems that, in turn, control the actual equipment in drilling system 100 (see also FIG. 5). The control of drilling equipment and drilling operations by the steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, the steering control system 168 may present various information, such as using a graphical user interface (GUI) displayed on a display device (see FIG. 8), to a human operator, and may provide controls that enable the human operator to perform a control operation. The information presented to the user may include live measurements and feedback from the drilling rig and the steering control system 168, or the drilling rig itself, and may further include limits and safety-related elements to prevent unwanted actions or equipment states, in response to a manual control command entered by the user using the GUI.

To implement semi-automatic control, the steering control system 168 may itself propose or indicate to the user, such as via the GUI, that a certain control operation, or a sequence of control operations, should be performed at a given time. Then, the steering control system 168 may enable the user to initiate the indicated control operation or sequence of control operations, such that once manually started, the indicated control operation or sequence of control operations is automatically completed. The limits and safety features mentioned above for manual control would still apply for semi-automatic control. The steering control system 168 may execute semi-automatic control using a secondary processor, such as an embedded controller that executes under a real-time operating system (RTOS), that is under the control and command of the steering control system 168. To implement automatic control, the step of manual starting the indicated control operation or sequence of operations is eliminated, and the steering control system 168 may proceed with only a passive notification to the user of the actions taken.

In order to implement various control operations, the steering control system 168 may perform (or may cause to be performed) various input operations, processing operations, and output operations. The input operations performed by the steering control system 168 may result in measurements or other input information being made available for use in any subsequent operations, such as processing or output operations. The input operations may accordingly provide the input information, including feedback from the drilling process itself, to the steering control system 168. The processing operations performed by the steering control system 168 may be any processing operation, as disclosed herein. The output operations performed by the steering control system 168 may involve generating output information for use by external entities, or for output to a user, such as in the form of updated elements in the GUI, for example. The output information may include at least some of the input information, enabling the steering control system 168 to distribute information among various entities and processors. In particular, the operations performed by the steering control system 168 may include operations such as receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, and calculating corrections for the drilling process if the drilling process is outside of the margin of error.

The steering control system 168 may receive input information either before drilling, during drilling, or after drilling of the borehole 106. The input information may comprise measurements from one or more sensors, as well as survey information collected while drilling the borehole 106. The input information may also include a drill plan, a regional formation history, drilling engineer parameters, downhole tool face/inclination information, downhole tool gamma/resistivity information, economic parameters, and reliability parameters, among various other parameters. Some of the input information, such as the regional formation history, may be available from a drilling hub 410, which may have respective access to a regional drilling database (DB) 412 (see FIG. 4). Other input information may be accessed or uploaded from other sources to the steering control system 168. For example, a web interface may be used to interact directly with the steering control system 168 to upload the drill plan or drilling parameters.

As noted, the input information may be provided to the steering control system 168. After processing by the steering control system 168, the steering control system 168 may generate control information that may be output to the drilling rig 210 (e.g., to rig controls 520 that control the drilling equipment 530, see also FIG. 2 and FIG. 5). The drilling rig 210 may provide feedback information using the rig controls 520 to the steering control system 168. The feedback information may then serve as input information to the steering control system 168, thereby enabling the steering control system 168 to perform feedback loop control and validation. Accordingly, the steering control system 168 may be configured to modify its output information to the drilling rig, in order to achieve the desired results, which are indicated in the feedback information. The output information generated by the steering control system 168 may include indications to modify one or more drilling parameters, the direction of drilling, and the drilling mode, among others. In certain operational modes, such as semi-automatic or automatic, the steering control system 168 may generate output information indicative of instructions to the rig controls 520 to enable automatic drilling using the latest location of the BHA 149. Therefore, an improved accuracy in the determination of the location of the BHA 149 may be provided using the steering control system 168.

Figure 2:
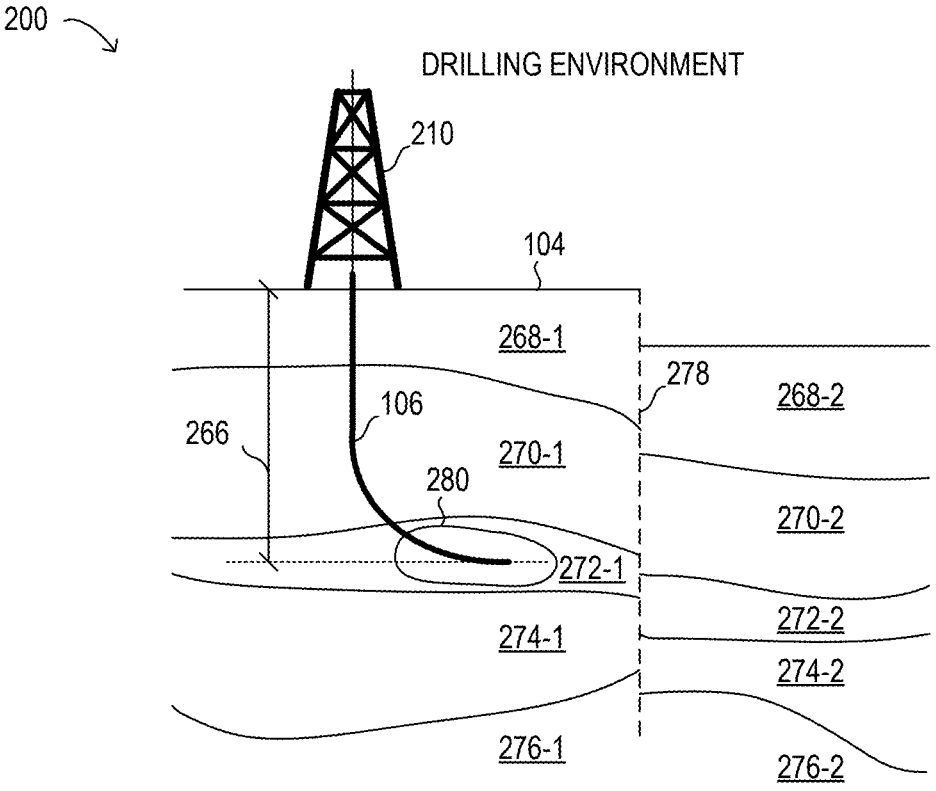
FIG. 2 illustrates a drilling environment that includes the drilling system of FIG. 1.

Referring now to FIG. 2, a drilling environment 200 is depicted schematically and is not drawn to scale or perspective. In particular, the drilling environment 200 may illustrate additional details with respect to the formation 102 below the surface 104 in the drilling system 100 shown in FIG. 1. In FIG. 2, the drilling rig 210 may represent various equipment discussed above with respect to drilling system 100 in FIG. 1 that is located at the surface 104.

In drilling environment 200, it may be assumed that a drill plan (also referred to as a well plan) has been formulated to drill the borehole 106 extending into one or more geological formations to a true vertical depth (TVD) 266 and penetrating several subterranean strata layers. The borehole 106 is shown in FIG. 2 extending through strata layers 268-1 and 270-1, and terminating in strata layer 272-1. Accordingly, as shown, the borehole 106 does not extend or reach underlying strata layers 274-1 and 276-1. An example target area 280 specified in the drill plan is located in strata layer 272-1 as shown in FIG. 2. The target area 280 may represent a desired endpoint of the borehole 106, such as a hydrocarbon producing area within the strata layer 272-1. The target area 280 may be of any shape and size and may be defined using various different methods and information in different embodiments. In some instances, the target area 280 may be specified in the drill plan using subsurface coordinates, or references to certain markers, that indicate where the borehole 106 is to be terminated. In other instances, the target area may be specified in the drill plan using a depth range within which the borehole 106 is to remain. For example, the depth range may correspond to the strata layer 272-1. In other examples, the target area 280 may extend as far as can be realistically drilled. For example, when the borehole 106 is specified to have a horizontal section with a goal to extend into the strata layer 172 as far as possible, the target area 280 may be defined as the strata layer 272-1 itself and drilling may continue until some other physical limit is reached, such as a property boundary or a physical limitation on the length of the drill string.

Also visible in FIG. 2 is a fault line 278 that has resulted in a subterranean discontinuity in the fault structure. Specifically, strata layers 268, 270, 272, 274, and 276 have portions on either side of the fault line 278. On one side of the fault line 278, where the borehole 106 is located, strata layers 268-1, 270-1, 272-1, 274-1, and 276-1 are unshifted by the fault line 278. On the other side of fault line 278, strata layers 268-2, 270-3, 272-3, 274-3, and 276-3 are shifted downwards by the fault line 278.

Current drilling operations frequently include directional drilling to reach a target, such as the target area 280. The use of directional drilling has been found to generally increase an overall amount of production volume per well, but also may lead to significantly higher production rates per well, which are both economically desirable. As shown in FIG. 2, directional drilling may be used to drill the horizontal portion of the borehole 106, which increases an exposed length of the borehole 106 within the strata layer 272-1, and which may accordingly be beneficial for hydrocarbon extraction from the strata layer 272-1. Directional drilling may also be used alter an angle of the borehole 106 to accommodate subterranean faults, such as indicated by fault line 278 in FIG. 2. Other benefits that may be achieved using directional drilling include sidetracking off of an existing well to reach a different target area or a missed target area, drilling around abandoned drilling equipment, drilling into otherwise inaccessible or difficult to reach locations (e.g., under populated areas or bodies of water), providing a relief well for an existing well, and increasing the capacity of a well by branching off and having multiple boreholes extending in different directions or at different vertical positions for the same well. Directional drilling is often not limited to a straight horizontal borehole 106 but may involve staying within a strata layer that varies in depth and thickness as illustrated by strata layer 272. As such, directional drilling may involve multiple vertical adjustments that complicate the trajectory of the borehole 106.

Figure 3:
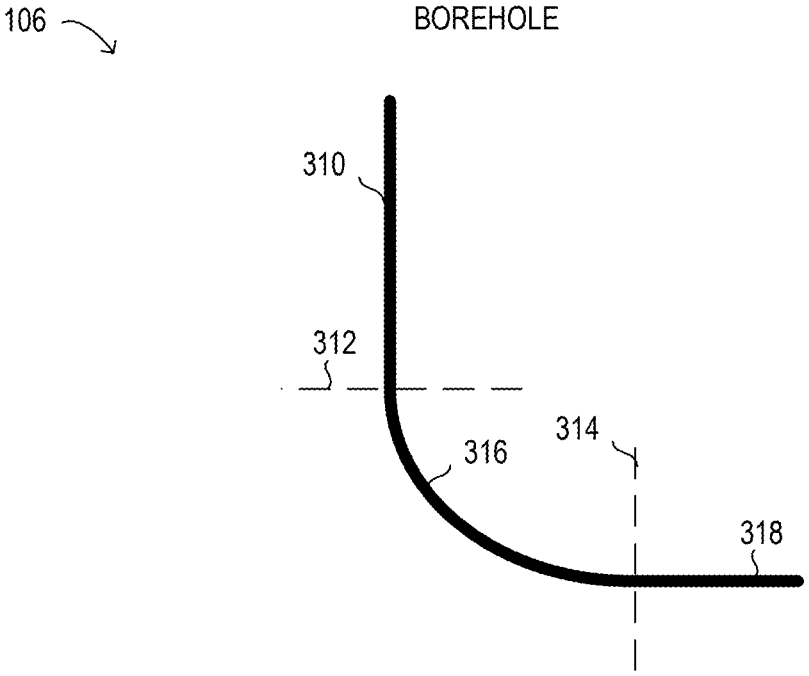
FIG. 3 illustrates a portion of a borehole generated in the drilling environment of FIG. 2.

Referring now to FIG. 3, one embodiment of a portion of the borehole 106 is shown in further detail. Using directional drilling for horizontal drilling may introduce certain challenges or difficulties that may not be observed during vertical drilling of the borehole 106. For example, a horizontal portion 318 of borehole 106 may be started from a vertical portion 310. In order to make the transition from vertical to horizontal, a curve may be defined that specifies a so-called "build section" 316. The build section 316 may begin at a kickoff point 312 in the vertical portion 310 and may end at a begin point 314 of the horizontal portion 318. The change in inclination in the build section 316 per measured length drilled is referred to herein as a "build rate" and may be defined in degrees per one hundred feet drilled. For example, the build rate may have a value of 6°/100 ft., indicating that there is a six degree change in inclination for everyone hundred feet drilled. The build rate for a particular build section may remain relatively constant or may vary.

The build rate used for any given build section may depend on various factors, such as properties of the formation (i.e., strata layers) through which the borehole 106 is to be drilled, the trajectory of the borehole 106, the particular pipe and drill collars/BHA components used (e.g., length, diameter, flexibility, strength, mud motor bend setting, and drill bit), the mud type and flow rate, the specified horizontal displacement, stabilization, and inclination, among other factors. An overly aggressive built rate can cause problems such as severe doglegs (e.g., sharp changes in direction in the borehole) that may make it difficult or impossible to run casing or perform other operations in the borehole 106. Depending on the severity of any mistakes made during directional drilling, the borehole 106 may be enlarged or the drill bit 146 may be backed out of a portion of the borehole 106 and redrilled along a different path. Such mistakes may be undesirable due to the additional time and expense involved. If, however, the build rate is too cautious, additional time may be added to the drilling process because directional drilling generally involves a lower ROP than straight drilling. Furthermore, directional drilling for a curve is more complicated than vertical drilling and the possibility of drilling errors increases with directional drilling (e.g., overshoot and undershoot that may occur while trying to keep the drill bit 148 on the planned trajectory).

Two modes of drilling, referred to herein as "rotating" and "sliding," are commonly used to form a borehole. Rotating, also called "rotary drilling," uses the top drive 140 to rotate the drill string 146. Rotating may be used when drilling occurs along a straight trajectory, such as for the vertical portion 310 of the borehole 106. Sliding, also called "steering" or "directional drilling" as noted above, typically uses a mud motor located downhole at the BHA 149. The mud motor may have an adjustable bent housing and is not powered by rotation of the drill string 146. Instead, the mud motor uses hydraulic power derived from the pressurized drilling mud pumped through the drill string 146 to directionally drill the borehole 106 in build section 316.

Sliding is used in order to control the direction of the well trajectory during directional drilling. A method to perform a slide may include the following operations. First, during vertical or straight drilling, the rotation of the drill string 146 is stopped. Based on feedback from measuring equipment, such as from the downhole tool 166, adjustments may be made to the drill string 146, such as using the top drive 140 to apply various combinations of torque, WOB, and vibration, among other adjustments. The adjustments may continue until a tool face is confirmed that indicates a direction of the bend of the mud motor is oriented to a direction of a desired deviation (i.e., build rate) of the borehole 106. Once the desired orientation of the mud motor is attained, WOB is increased, which causes the drill bit 148 to move in the desired direction of deviation. Once sufficient distance and angle have been built up in the curved trajectory, a transition back to rotating mode can be accomplished by restarting rotation of the drill string 146. The rotation of the drill string 146 after sliding may neutralize the directional deviation caused by the bend in the mud motor due to the continuous rotation around a centerline of the borehole 106.

Figure 4:
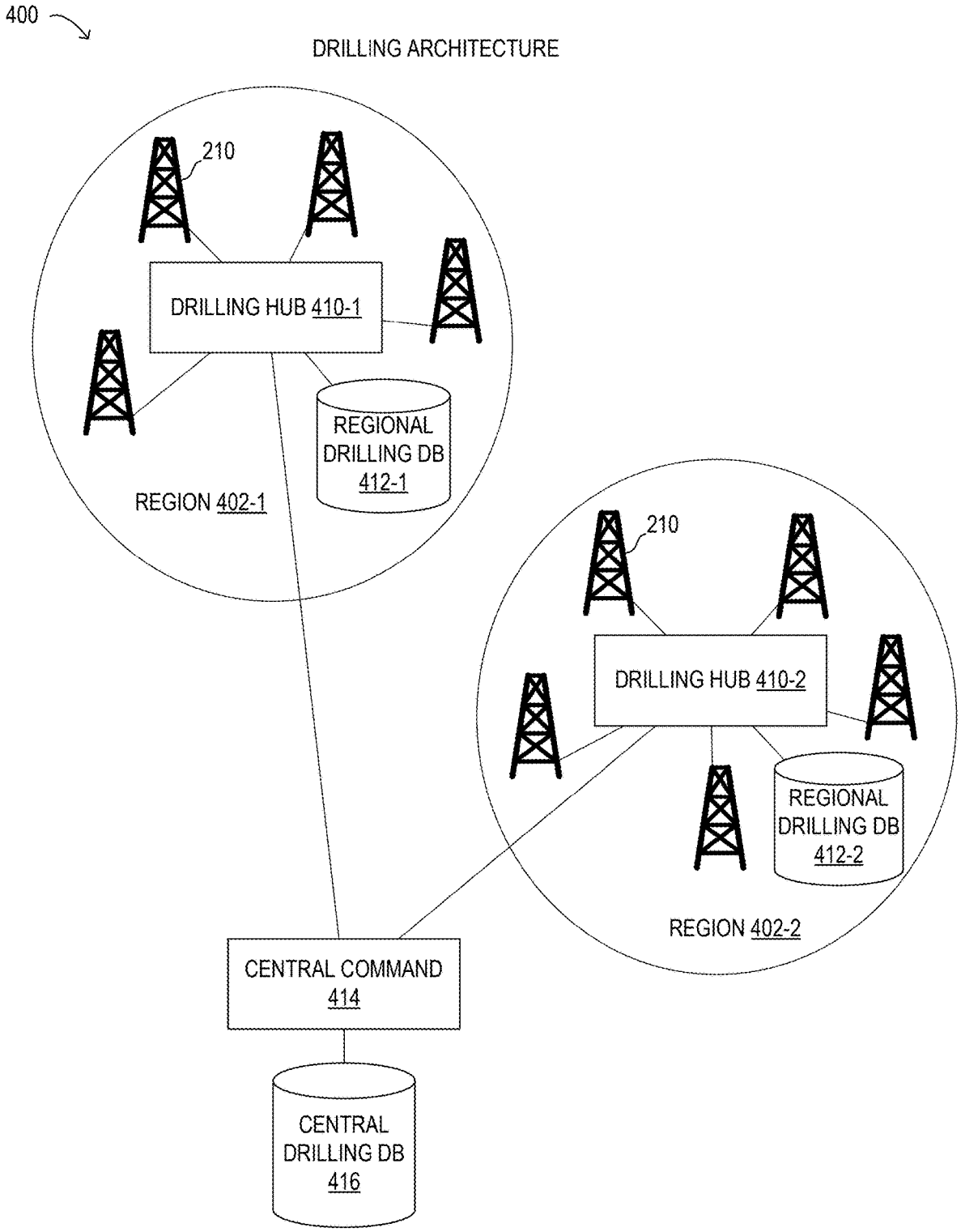
FIG. 4 illustrates a drilling architecture that includes the drilling environment of FIG. 2.

Referring now to FIG. 4, a drilling architecture 400 is illustrated in diagram form. As shown, the drilling architecture 400 depicts a hierarchical arrangement of drilling hubs 410 and a central command 414, to support the operation of a plurality of drilling rigs 210 in different regions 402. Specifically, as described above with respect to FIG. 1 and FIG. 2, the drilling rig 210 includes the steering control system 168 that is enabled to perform various drilling control operations locally to the drilling rig 210. When the steering control system 168 is enabled with network connectivity, certain control operations or processing may be requested or queried by the steering control system 168 from a remote processing resource. As shown in FIG. 4, the drilling hubs 410 represent a remote processing resource for the steering control system 168 located at respective regions 402, while the central command 414 may represent a remote processing resource for both the drilling hub 410 and the steering control system 168.

Specifically, in a region 401-1, a drilling hub 410-1 may serve as a remote processing resource for the drilling rigs 210 located in region 401-1, which may vary in number and are not limited to the exemplary schematic illustration of FIG. 4. Additionally, the drilling hub 410-1 may have access to a regional drilling DB 412-1, which may be local to drilling hub 410-1. Additionally, in a region 401-2, a drilling hub 410-2 may serve as a remote processing resource for the drilling rigs 210 located in the region 401-2, which may vary in number and are not limited to the exemplary schematic illustration of FIG. 4. Additionally, the drilling hub 410-2 may have access to a regional drilling DB 412-2, which may be local to drilling hub 410-2.

In FIG. 4, respective regions 402 may exhibit the same or similar geological formations. Thus, reference wells, or offset wells, may exist in a vicinity of a given drilling rig 210 in the region 402, or where a new well is planned in the region 402. Furthermore, multiple drilling rigs 210 may be actively drilling concurrently in the region 402 and may be in different stages of drilling through the depths of formation strata layers at the region 402. Thus, for any given well being drilled by a drilling rig 210 in a region 402, survey data from the reference wells or offset wells may be used to create the drill plan and may be used for improved drilling performance. In some implementations, survey data or reference data from a plurality of reference wells may be used to improve drilling performance, such as by reducing an error in estimating true vertical depth (TVD) or a position of the BHA 149 relative to one or more strata layers, as will be described in further detail herein. Additionally, survey data from recently drilled wells, or wells still currently being drilled, including the same well, may be used for reducing an error in estimating TVD or a position of the BHA 149 relative to one or more strata layers.

Also shown in FIG. 4 is central command 414, which has access to a central drilling database (DB) 416, and may be located at a centralized command center that is in communication with drilling hubs 410 and drilling rigs 210 in the various regions 402. The centralized command center may have the ability to monitor drilling and equipment activity at any one or more of the drilling rigs 210. In some embodiments, the central command 414 and the drilling hubs 412 may be operated by a commercial operator of the drilling rigs 210 as a service to customers who have hired the commercial operator to drill wells and provide other drilling-related services.

In FIG. 4, the central drilling DB 416 may be a central repository that is accessible to the drilling hubs 410 and the drilling rigs 210. Accordingly, the central drilling DB 416 may store information for the various drilling rigs 210 in the different regions 402. In some embodiments, the central drilling DB 416 may serve as a backup for at least one regional drilling DB 412 or may otherwise redundantly store information that is also stored on at least one regional drilling DB 412. Likewise, the regional drilling DB 412 may serve as a backup or redundant storage for at least one drilling rig 210 in the region 402. For example, the regional drilling DB 412 may store information collected by the steering control system 168 from the drilling rig 210.

In some embodiments, the formulation of a drill plan for a drilling rig 210 may include processing and analyzing the collected data in the regional drilling DB 412 to create a more effective drill plan. Furthermore, once drilling has begun, the collected data may be used in conjunction with current data from the drilling rig 210 to improve drilling decisions. As noted, the functionality of the steering control system 168 may be provided at the drilling rig 210, or may be provided, at least in part, at a remote processing resource, such as the drilling hub 410 or the central command 414.

As noted, the steering control system 168 may provide functionality as a surface steerable system for controlling the drilling rig 210. The steering control system 168 may have access to the regional drilling DB 412 and the central drilling DB 416 to provide the surface steerable system functionality. As will be described in greater detail below, the steering control system 168 may be used to plan and control drilling operations based on input information, including feedback from the drilling process itself. The steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at the drilling rig 210, monitoring the drilling process to gauge whether the drilling process is within a margin of error that is defined for the drill trajectory, or calculating corrections for the drilling process if the drilling process is outside of the margin of error.

Figure 5:
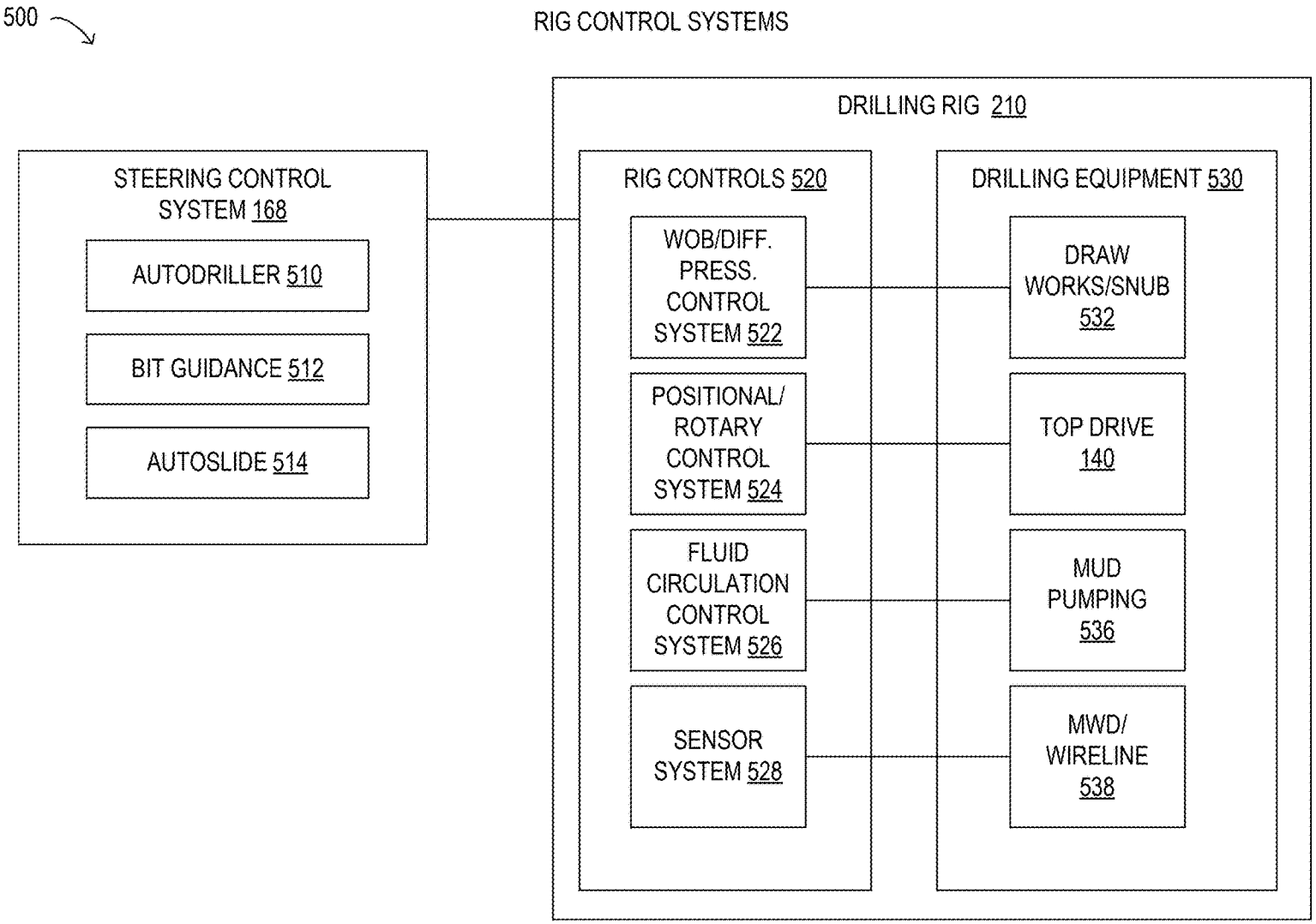
FIG. 5 shows drilling rig control systems of the drilling system of FIG. 1.

Referring now to FIG. 5, an example of rig control systems 500 is illustrated in schematic form. The rig control systems 500 may include fewer or more elements than shown in FIG. 5 in different embodiments. In the illustrated embodiment, the rig control systems 500 include the steering control system 168 and the drilling rig 210. Specifically, the steering control system 168 is shown with logical functionality including an auto driller 510, a bit guidance 512, and an auto slide 514. The drilling rig 210 is hierarchically shown including rig controls 520, which provide secure control logic and processing capability, along with drilling equipment 530, which represents the physical equipment used for drilling via the drilling rig 210. As shown, the rig controls 520 include a WOB/differential pressure control system 522, a positional/rotary control system 524, a fluid circulation control system 526, and a sensor system 528, while the drilling equipment 530 includes a draw works/snub 532, the top drive 140, mud pumping equipment 536, and MWD/wireline equipment 538.

The steering control system 168 can include one or more processors and one or more tangible memory devices storing non-transient instructions executable by the one or more processors to cause the one or more processors to accomplish the functionality described herein with respect to the steering control system 168. Likewise, each of the WOB/differential pressure control system 522, the positional/rotary control system 524, and the fluid circulation control system 526 can include one or more processors and one or more tangible memory devices storing non-transient instructions executable by the one or more processors to cause the one or more processors to accomplish the functionality described herein with respect to the respective control system. In alternate embodiments, one or more programmable logic controllers (PLCs) may be employed to provide the functionality described herein with respect to the respective control system. Accordingly, each of the systems included in rig controls 520 may be a separate controller, such as a PLC, and may autonomously operate, at least to a degree. The steering control system 168 may represent hardware that executes instructions to implement a surface steerable system that provides feedback and automation capability to an operator, such as a driller. For example, the steering control system 168 may cause the auto driller 510, the bit guidance 512 (also referred to as a bit guidance system (BGS)), and the auto slide 514 (among others, not shown) to be activated and executed at an appropriate time during drilling. In particular implementations, the steering control system 168 may be enabled to provide a user interface during drilling, such as the user interface 850 depicted and described below with respect to FIG. 8. Accordingly, the steering control system 168 may interface with the rig controls 520 to facilitate manual, assisted manual, semi-automatic, and automatic operation of the drilling equipment 530 included in the drilling rig 210. The rig controls 520 may also accordingly be enabled for manual or user-controlled operation of drilling and may include certain levels of automation with respect to the drilling equipment 530.

In the rig control systems 500 of FIG. 5, the WOB/differential pressure control system 522 may be interfaced with the draw works/snubbing unit 532 to control WOB. The positional/rotary control system 524 may be interfaced with the top drive 140 to control rotation of the drill string 146. The fluid circulation control system 526 may be interfaced with the mud pumping equipment 536 to control mud flow and may also receive and decode mud telemetry signals. The sensor system 528 may be interfaced with the MWD/wireline equipment 538, which may represent various BHA sensors and instrumentation equipment, among other sensors that may be downhole or at the surface.

In the rig control systems 500, the auto driller 510 may represent an automated rotary drilling system and may be used for controlling rotary drilling. Accordingly, the auto driller 510 may enable automatic operation of the rig controls 520 during rotary drilling, as indicated in the drill plan. The bit guidance 512 may represent an automated control system to monitor and control performance and operation of the drill bit 148.

In the rig control systems 500, the auto slide 514 may represent an automated slide drilling system and may be used for controlling slide drilling. Accordingly, the auto slide 514 may enable automatic operation of the rig controls 520 during a slide and may return control to the steering control system 168 for rotary drilling at an appropriate time, as indicated in the drill plan. In particular implementations, the auto slide 514 may be enabled to provide a user interface during slide drilling to specifically monitor and control the slide. For example, auto slide 514 may rely on the bit guidance 512 for orienting a tool face and on the auto driller 510 to set WOB or control rotation or vibration of the drill string 146.

Figure 6:
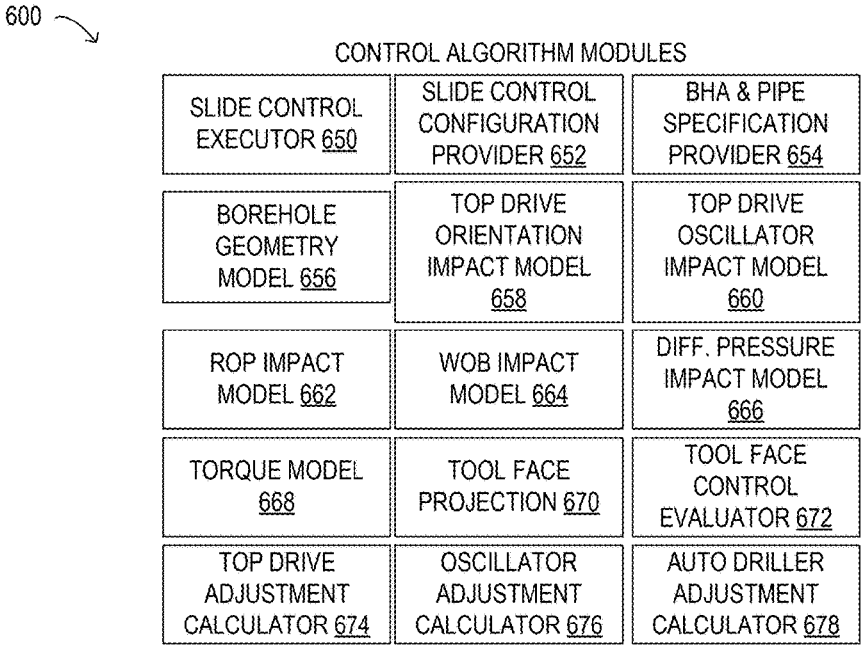
FIG. 6 shows control algorithm modules of the rig control systems of FIG. 5.

FIG. 6 shows a collection of control algorithm modules 600 used with the steering control system 168. The control algorithm modules 600 include a slide control executor 650, a slide control configuration provider 652, a BHA and pipe specification provider 654, a borehole geometry model 656, a top drive orientation impact model 658, a top drive oscillator impact model 660, a ROP impact model 662, a WOB impact model 664, a differential pressure impact model 666, a torque model 668, a tool face projection module 670, a tool face control evaluator 672, a top drive adjustment calculator module 674, an oscillator adjustment calculator 676, and an auto driller adjustment calculator 678. The slide control executor 650 is responsible for managing execution of the slide control algorithms. The slide control configuration provider 652 is responsible for validating, maintaining, and providing configuration parameters for the other control algorithm modules 600. The BHA & pipe specification provider 654 is responsible for managing and providing details of the BHA 149 and the drill string 146 characteristics. The borehole geometry model 656 is responsible for keeping track of the borehole geometry and providing a representation of the borehole geometry to other software modules. The top drive orientation impact model 658 is responsible for modeling the impact that changes to the angular orientation of the top drive 140 have had on the tool face control. The top drive oscillator impact model 660 is responsible for modeling the impact that oscillations of the top drive 140 has had on the tool face control. The ROP impact model 662 is responsible for modeling the effect on the tool face control of a change in ROP or a corresponding ROP set point. The WOB impact model 664 is responsible for modeling the effect on the tool face control of a change in WOB or a corresponding WOB set point. The differential pressure impact model 666 is responsible for modeling the effect on the tool face control of a change in differential pressure (DP) or a corresponding DP set point. The torque model 668 is responsible for modeling the comprehensive representation of torque for surface, downhole, break over, and reactive torque, modeling impact of those torque values on tool face control, and determining torque operational thresholds. The tool face control evaluator 672 is responsible for evaluating all factors impacting tool face control and whether adjustments need to be projected, determining whether re-alignment off-bottom is indicated, and determining off-bottom tool face operational threshold windows. The tool face projection 670 is responsible for projecting tool face behavior for top drive 140, the top drive oscillator, and auto driller adjustments. The top drive adjustment calculator 674 is responsible for calculating top drive adjustments resultant to tool face projections. The oscillator adjustment calculator 676 is responsible for calculating oscillator adjustments resultant to tool face projections. The auto driller adjustment calculator 678 is responsible for calculating adjustments to auto driller 510 resultant to tool face projections.

Figure 7:
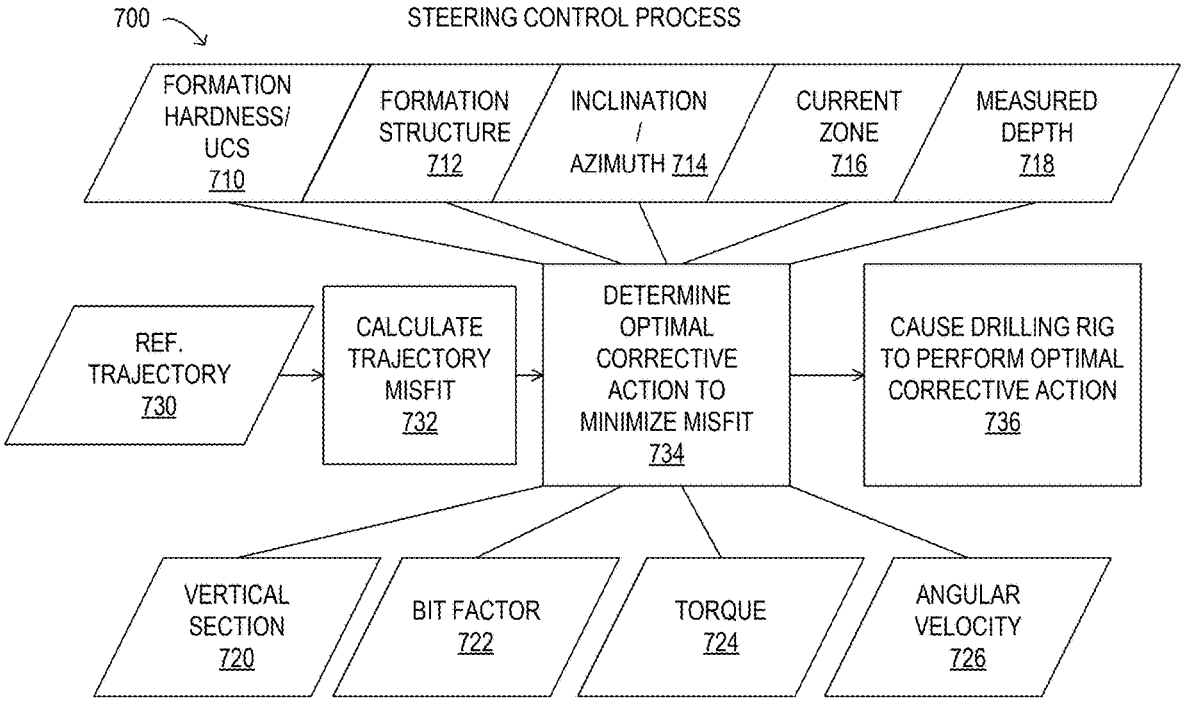
FIG. 7 schematically illustrates a steering control process used by the rig control systems of FIG. 5.

FIG. 7 illustrates a steering control process 700 for determining an optimal corrective action for drilling. The steering control process 700 may be used for rotary drilling or slide drilling in different embodiments.

The steering control process 700 employs a variety of inputs that can be used to determine an optimum corrective action. The inputs include formation hardness/unconfined compressive strength (UCS) 710, formation structure 712, inclination/azimuth 714, current zone 716, measured depth 718, vertical section 720, bit factor 722, mud motor torque 724, reference trajectory 730, and angular velocity 726. The reference trajectory 730 of borehole 106 is determined to calculate a trajectory misfit in act 732. Act 732 may output the trajectory misfit to determine an optimal corrective action to minimize the misfit at act 734, which may be performed using the other inputs described above. Then, at act 736, the drilling rig is caused to perform the optimal corrective action.

In some implementations, at least certain portions of the steering control process 700 may be automated or performed without user intervention, such as operating the rig control systems 500. In other implementations, the accomplishment of the optimal corrective action in act 736 may be provided or communicated (by display, SMS message, email, or otherwise) to one or more human operators, who may then take appropriate action. The one or more human operators may be members of a rig crew, which may be located at or near the drilling rig 210 or may be located remotely from the drilling rig 210.

Figure 8:
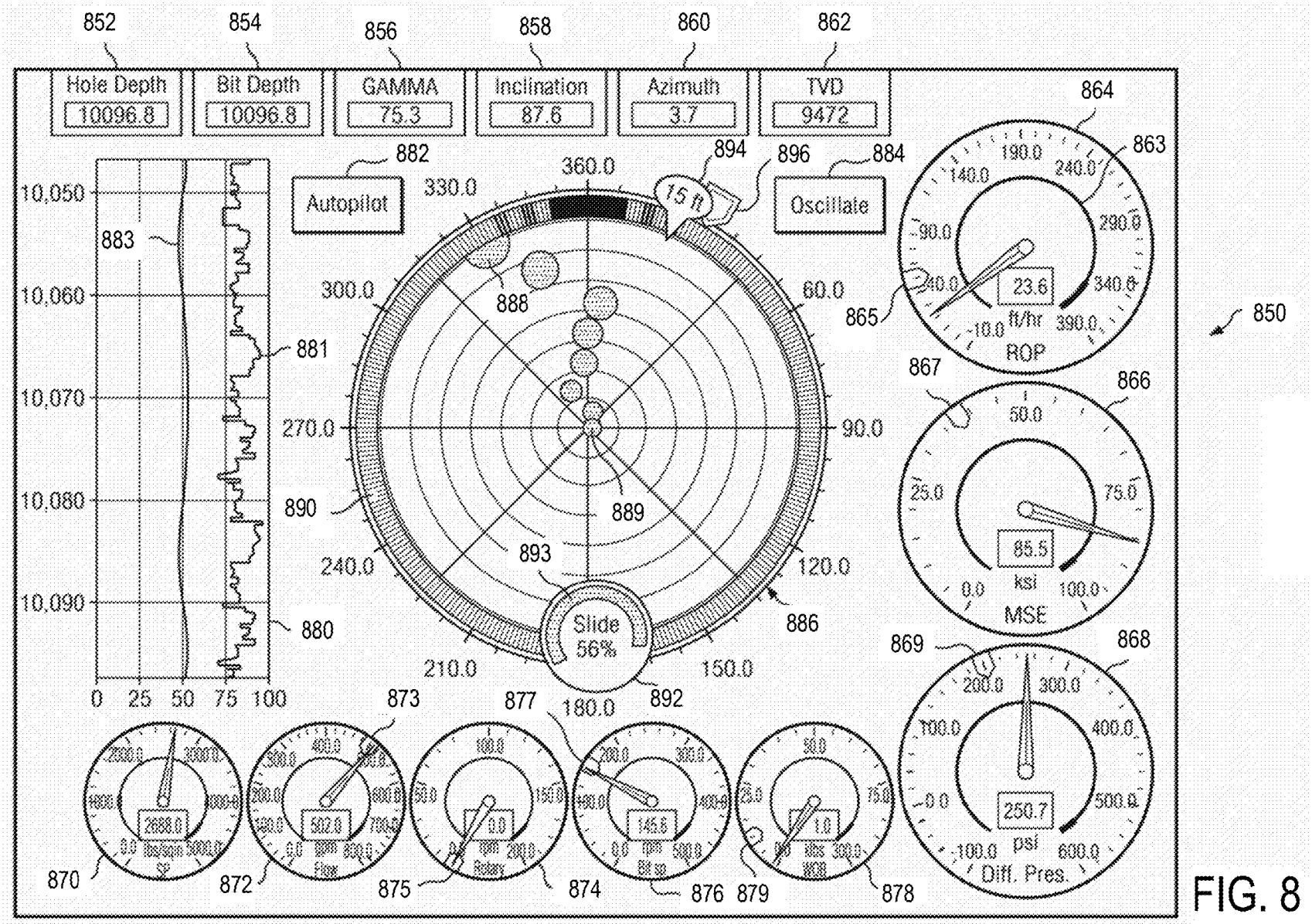
FIG. 8 illustrates a dashboard of the rig control systems of FIG. 5.

Referring to FIG. 8, a user interface 850 that may be generated by the steering control system 168 for monitoring and operation by a human operator is illustrated. The user interface 850 provides many different types of information in an easily accessible format. The user interface 850 may be shown on a computer monitor, a television, a viewing screen (e.g., a display device) associated with the steering control system 168. In some embodiments, at least certain portions of user interface 850 may be displayed to and operated by a user of the steering control system 168 on a mobile device, such as a tablet or a smartphone. For example, the steering control system 168 may support mobile applications that enable the user interface 850, or other user interfaces, to be used on a mobile device, for example, within a vicinity of the drilling rig 210.

As shown in FIG. 8, the user interface 850 includes a hole depth indicator 852, a bit depth indicator 854, a gamma ray indicator 856, an inclination indicator 858, an azimuth indicator 860, and a TVD indicator 862 distributed across the top of the user interface 850. The user interface 850 further includes a rate of penetration (ROP) indicator 864, a mechanical specific energy (MSE) indicator 866, a differential pressure indicator 868, a standpipe pressure indicator 870, a flow rate indicator 872, a rotary RPM (angular velocity) indicator 874, a bit speed indicator 876, and a WOB indicator 878.

In the user interface 850, each of the indicators 864, 866, 868, 872, 874, 876, and 878 includes a marker representing a target value. While each of the markers in FIG. 8 is set to a particular target value, the marker can be set to any suitable target value. Although not shown in FIG. 8, multiple markers may be present on a single indicator. The markers may vary in color or size. The ROP indicator 864 includes a marker 865 indicating that the target value is 50 feet/hour (or 15 miles/hour). The MSE indicator 866 includes a marker 867 indicating that the target value is 37 kilograms per square inch (ksi) (or 255 MPa). The differential pressure indicator 868 includes a marker 869 indicating that the target value is 200 pounds per square inch (psi) (or 1,380 kilo Pascal (kPa)). The flow rate indicator 872 includes a marker 873 indicating that the target value is 500 gallons per minute (gpm) (or 31.5 liters per second (L/s)). The rotary RPM indicator 874 includes a marker 875 indicating that the target value is 0 RPM (e.g., due to sliding). The bit speed indicator 876 includes a marker 877 indicating that the target value is 150 RPM. The WOB indicator 878 includes a marker 879 indicating that the target value is 10 kips (or 4,500 kg). Each indicator may also include a colored band, or another marking, to indicate, for example, whether the respective gauge value is within a safe range (e.g., indicated by a green color), within a caution range (e.g., indicated by a yellow color), or within a danger range (e.g., indicated by a red color).

The user interface 850 includes a log chart 880 that can display depth versus one or more measurements (e.g., may represent log inputs relative to a progressing depth chart). For example, the log chart 880 may have a Y-axis representing depth and an X-axis representing a measurement such as gamma ray count 881 (as shown), a ROP 883 (e.g., empirical ROP and normalized ROP), or resistivity. The user interface 850 includes an autopilot button 882 and an oscillate button 884. The autopilot button 882 may be used to engage or disengage the auto driller 510. The oscillate button 884 may be used to directly control oscillation of the drill string 146 or to engage/disengage an external hardware device or controller.

The user interface 850 includes a circular chart 886 for displaying current and historical tool face orientation information (e.g., which way the bend is pointed). The circular chart 886 represents three hundred and sixty degrees. A series of circles displayed within the circular chart 886 represent a timeline of tool face orientations, with the sizes of the circles indicating the temporal position of each circle. For example, larger circles may be more recent than smaller circles, so a largest circle 888 may be the newest reading and a smallest circle 889 may be the oldest reading. In other embodiments, circles 889, 888 may represent the energy or progress made via size, color, shape, a number within a circle, etc. For example, a size of a particular circle may represent an accumulation of orientation and progress for the period of time represented by the circle. In other embodiments, concentric circles representing time (e.g., with the outside of the circular chart 886 being the most recent time and the center point being the oldest time) may be used to indicate the energy or progress (e.g., via color or patterning such as dashes or dots rather than a solid line).

In the user interface 850, the circular chart 886 may also be color coded, with the color coding existing in a band 890 around the circular chart 886 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular tool face orientation with little deviation. As shown in user interface 850, the color blue may extend from approximately 22-337 degrees, the color green may extend from approximately 15-22 degrees and 337-345 degrees, the color yellow may extend a few degrees around the 13- and 345-degree marks, while the color red may extend from approximately 347-10 degrees. Transition colors or shades may be used with, for example, the color orange marking the transition between red and yellow or a light blue marking the transition between blue and green. This color coding may enable the user interface 850 to provide an intuitive summary of how narrow the standard deviation is and how much of the energy intensity is being expended in the proper direction. Furthermore, the center of energy may be viewed relative to the target. For example, the user interface 850 may clearly show that the target is at 90 degrees, but the center of energy is at 45 degrees.

The user interface 850 further includes a slide indicator 892. The slide indicator 892 indicates how much time remains until a slide occurs or how much time remains for a current slide. For example, the slide indicator 892 may represent a time, a percentage (e.g., as shown, a current slide may be 56% complete), a distance completed, or a distance remaining. The slide indicator 892 may graphically display information using, for example, a colored bar 893 that increases or decreases with slide progress. In some embodiments, the slide indicator 892 may be built into the circular chart 886 (e.g., around the outer edge with an increasing/decreasing band), while in other embodiments the slide indicator 892 may be a separate indicator such as a meter, a bar, a gauge, or another indicator type. In various implementations, the slide indicator 892 may be refreshed by the auto slide 514.

The user interface 850 further includes an error indicator 894 that indicates a magnitude and a direction of error. For example, the error indicator 894 may indicate that an estimated drill bit position is a certain distance from the planned trajectory, with a location of the error indicator 894 around the circular chart 886 representing the heading. For example, the error indicator 894 in FIG. 8 illustrates an error magnitude of 15 feet and an error direction of 15 degrees. The error indicator 894 may be any color but may be red for purposes of example. The error indicator 894 may display a zero if there is no error. The error indicator may represent that the drill bit 148 is on the planned trajectory using other means, such as being a green color. Transition colors, such as yellow, may be used to indicate varying amounts of error. In some embodiments, the error indicator 894 may not appear unless there is an error in magnitude or direction. The user interface 850 further includes a marker 896 that indicates an ideal slide direction. Although not shown, other indicators may be present, such as a bit life indicator to indicate an estimated lifetime for the current bit based on a value such as time or distance.

The user interface 850 may be arranged in many different ways. For example, colors may be used to indicate normal operation, warnings, and problems. In such cases, the numerical indicators may display numbers in one color (e.g., green) for normal operation, may use another color (e.g., yellow) for warnings, and may use yet another color (e.g., red) when a serious problem occurs. The indicators may also flash or otherwise indicate an alert. The gauge indicators may include colors (e.g., green, yellow, and red) to indicate operational conditions and may also indicate the target value (e.g., an ROP of 100 feet/hour). For example, the ROP indicator 864 may have a green bar to indicate a normal level of operation (e.g., from 10-300 feet/hour), a yellow bar to indicate a warning level of operation (e.g., from 300-360 feet/hour), and a red bar to indicate a dangerous or otherwise out of parameter level of operation (e.g., from 360-390 feet/hour). The ROP indicator 864 may also display a marker at 100 feet/hour to indicate the desired target ROP.

Furthermore, the use of numeric indicators, gauges, and similar visual display indicators may be varied based on factors such as the information to be conveyed and the personal preference of the viewer. Accordingly, the user interface 850 may provide a customizable view of various drilling processes and information for a particular individual involved in the drilling process. For example, the steering control system 168 may enable a user to customize the user interface 850 as desired, although certain features (e.g., standpipe pressure) may be locked to prevent a user from intentionally or accidentally removing important drilling information from the user interface 850. Other features and attributes of the user interface 850 may be set by user preference. Accordingly, the level of customization and the information shown by the user interface 850 may be controlled based on who is viewing the user interface 850 and their role in the drilling process.

Compensated SWOB

Figure 10:
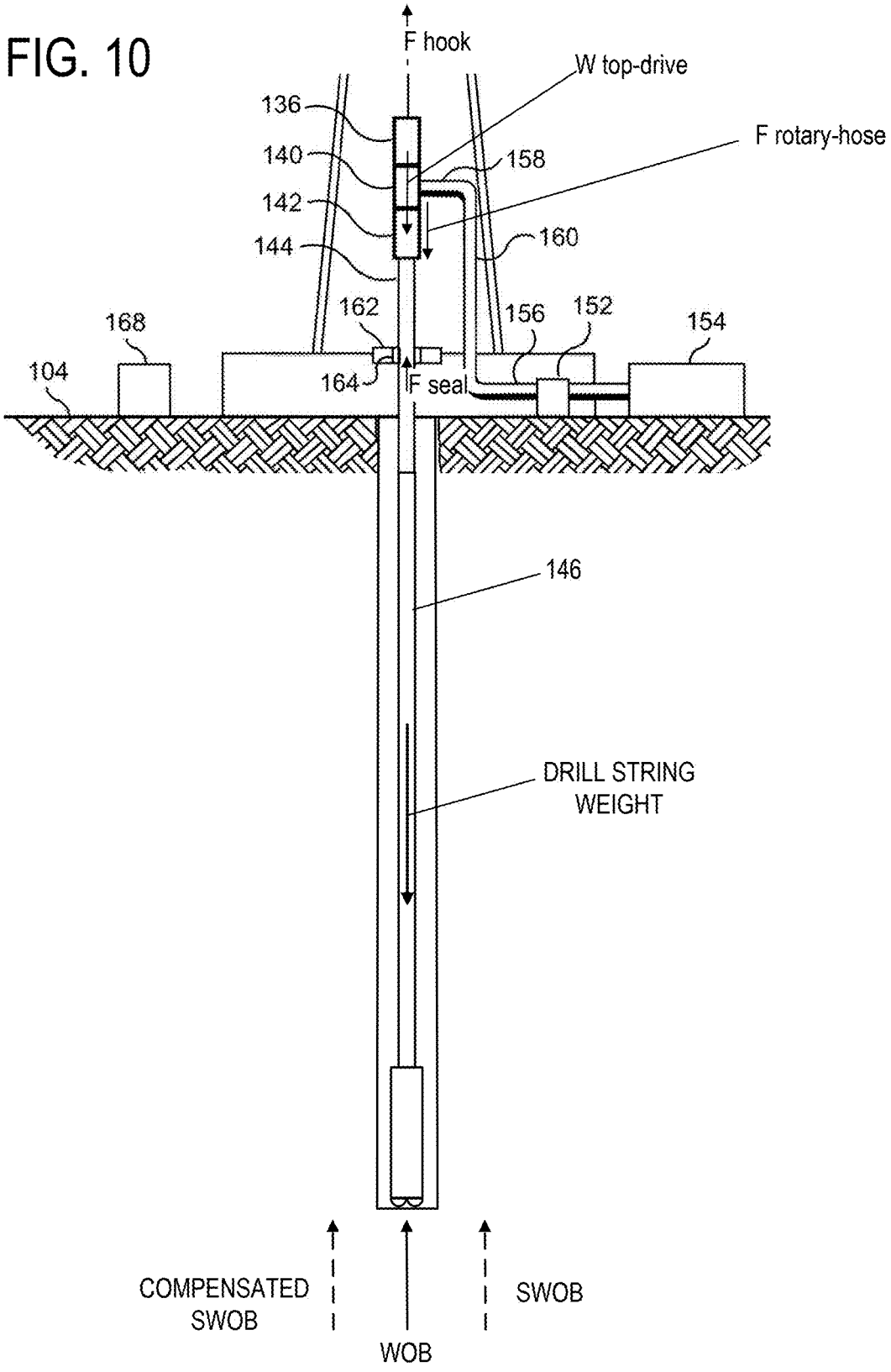
FIG. 10 illustrates drilling rig forces that can be used to determine surface weight-on-bit and a compensated surface weight-on-bit, in accordance with embodiments.

Referring now to FIG. 10, the amount of force applied to the drill bit by the drill string is typically referred to as "weight-on-bit" (WOB). WOB is typically controlled to optimize drilling performance. Although WOB can be directly measured via a suitably instrumented BHA, surface weight-on-bit (SWOB) is a more readily derivable drilling parameter that is often used as a surrogate for WOB. SWOB is defined as the difference between the free-hanging weight (i.e., off bottom) of the drill string (which can include the weight of the BHA) and the vertical support load (aka "hook load") applied to the top drive by the hoisting system. SWOB may, however, deviate substantially from WOB in certain circumstances.

In embodiments, a compensated SWOB is determined that compensates for the substantial intermittent reductions in hook load caused by the passage of the tool joints through the rotating seal of the rotating control device. The compensated SWOB can also account for any significant additional factors that may produce deviation between SWOB and WOB such as, but not limited to, the combined weight of the traveling block and top drive, forces applied by the drag chains, drill pipe buoyancy effects, and forces applied by the drilling mud hose. Operation of the drilling system during drilling of a borehole can be controlled based at least in part on the compensated SWOB. In embodiments, the compensated SWOB is used as a control parameter for use in controlling the hoisting system to optimize drilling of a borehole. In some embodiments, an axial internal load in the drill string 146 ($F_{top\text{-}of\text{-}borehole}$) (below and adjacent to the rotating control device 162 as shown in FIG. 10) is determined and monitored for use in controlling a drill rig during drilling operations to enhance efficiency and/or cost effectiveness of drilling of a borehole.

Figure 9:
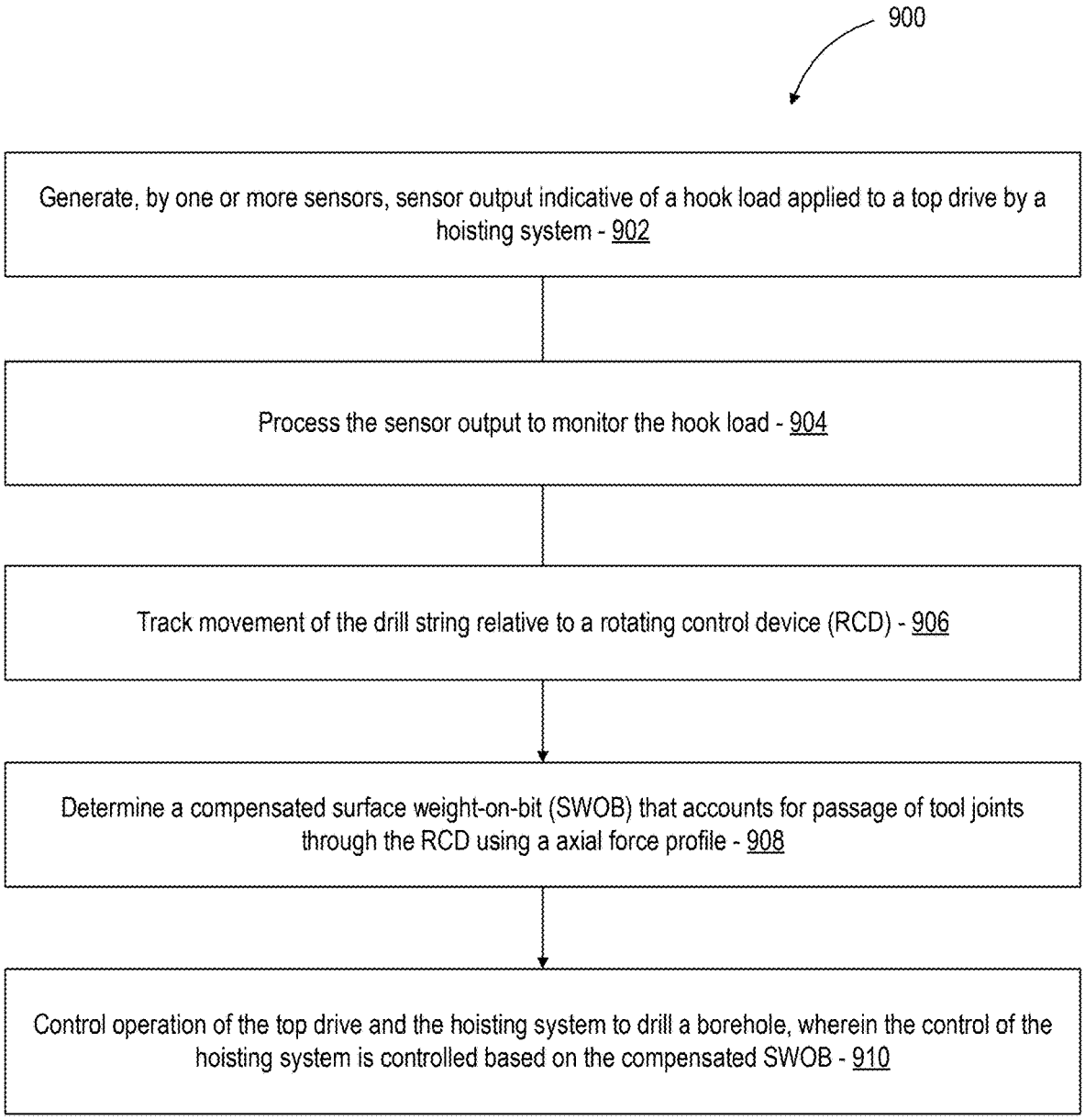
FIG. 9 shows a simplified schematic diagram illustrating a method of controlling operation of a top drive and/or a hoist system to drill a borehole based on a compensated surface weight-on-bit, in accordance with embodiments.

FIG. 9 shows a simplified schematic diagram illustrating a method 900 of controlling operation of a top drive and/or a hoist system to drill a borehole based on a compensated SWOB, in accordance with embodiments. The method 900 can be practiced using any suitable drilling system, such as the drilling system 100.

At step 902, one or more sensors generate sensor output indicative of a hook load ($F_{hook}$) applied to a top drive by a hoisting system. As shown in FIG. 10, the hook load ($F_{hook}$) can be applied to the traveling block 136, which is attached to the top drive 140.

At step 904, the sensor output is processed to monitor the hook load ($F_{hook}$). In embodiments, the sensor output is repeatedly processed to provide real time monitoring of the hook load ($F_{hook}$) over a suitable drilling timespan.

At step 906, movement of a drill string relative to a rotating control device (RCD) is tracked. In embodiments, the drill string includes drill pipes that are sequentially coupled by tool joints, wherein each of the tool joints connects two of the drill pipes. As described herein, the position of one or more tool joints relative to the rotating control device can be used to determine when one of the tool joints is in entering, passing through, and/or exiting the rotating control device. In some aspects, the location of the respective tool joints relative to the RCD may be determined by one or more of a machine vision system, calculations based on information regarding the drill string (including the elevator etc.) and the wellbore, manual visual monitoring of the drill string, WOB monitoring, or other suitable means for determining the location of a tool joint relative to the RCD.

At step 908, a compensated SWOB is determined that accounts for passage of the tool joints through the RCD 162. Referring now to FIG. 10, in embodiments, the compensated SWOB is based on a difference between the drill string weight and the hook load ($F_{hook}$) when the RCD 162 is not engaged by any of the tool joints. During passage of each of the tool joints through the RCD 162, the compensated SWOB can be based on a difference between the drill string weight and the hook load ($F_{hook}$) minus a force ($F_{seal}$) defined by an axial resistance force profile during passage of each of the tool joints through the RCD 162. In embodiments, the force ($F_{seal}$) defined by the axial resistance force profile varies over a length of travel of the tool joint through the RCD 162.

At step 910, operation of the top drive 140 and the hoisting system is controlled and the borehole is drilled. In some embodiments, the operation of the hoisting system is controlled based on the compensated SWOB.

Figure 11:
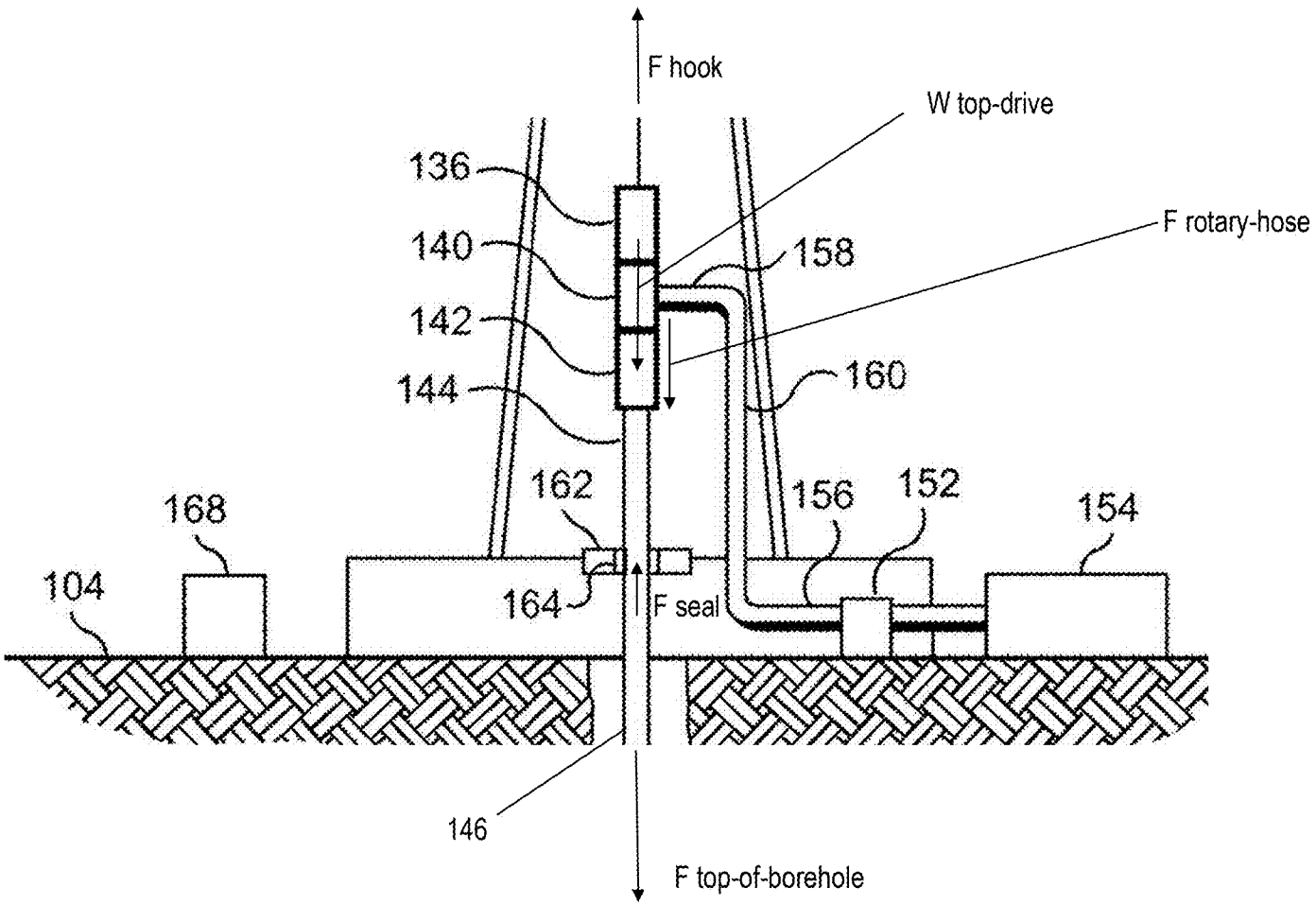
FIG. 11 and FIG. 12 illustrate drilling rig forces that can be used to determine an axial force within a drill string, in accordance with embodiments.
Figure 12:
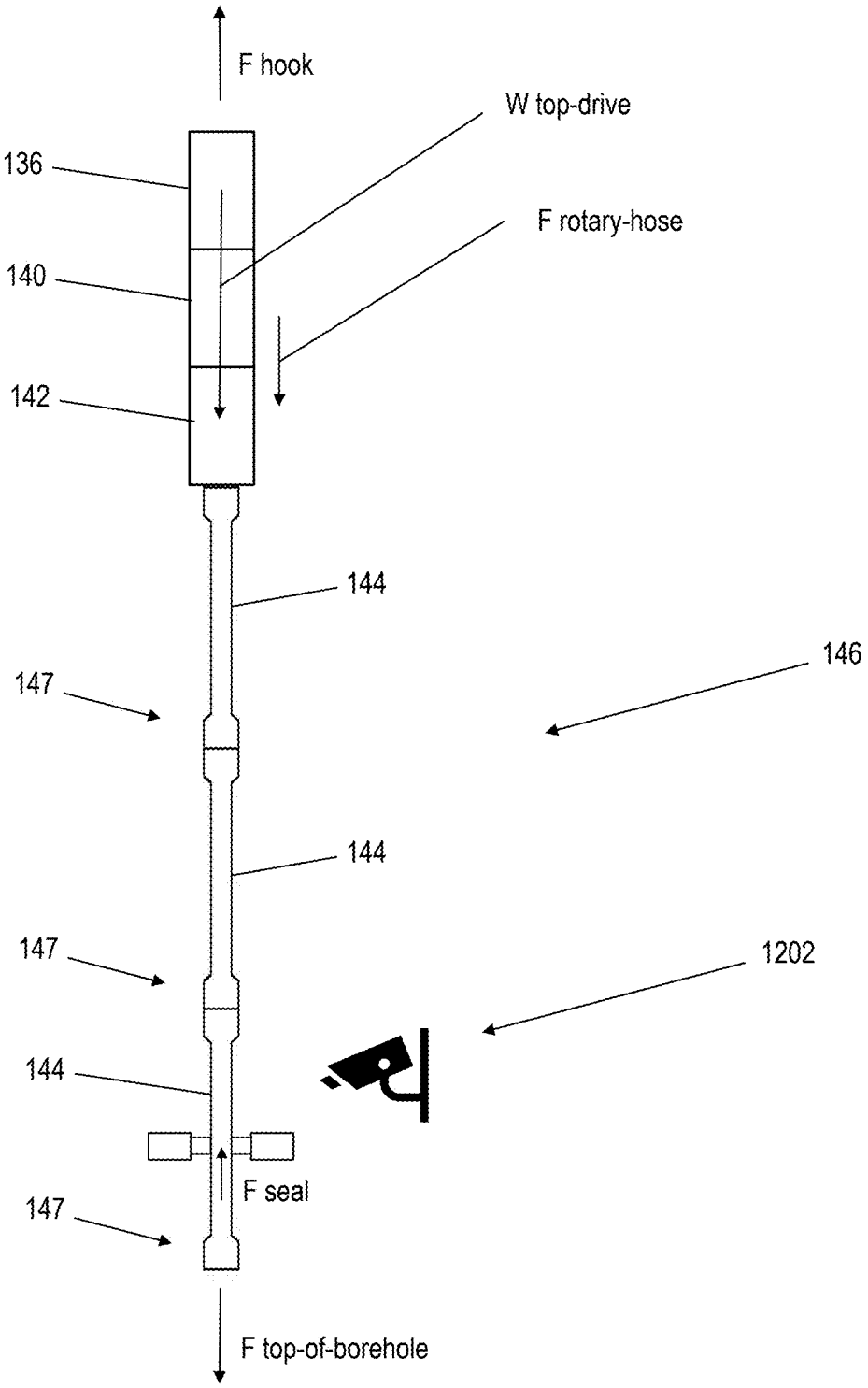

As illustrated in FIG. 11 and FIG. 12, the axial internal load in the drill string can be calculated for a cross-section of the drill string 146 that is below the rotating control device 162. The vertical support load ("$F_{hook}$") applied to the top drive 140 (via the traveling block 136) by the hoisting system of the drilling system reacts a large part of the axial internal load in the drill string ($F_{top\text{-}of\text{-}borehole}$). As discussed herein, the magnitude of the axial internal load in the drill string ($F_{top\text{-}of\text{-}borehole}$) typically deviates from the magnitude of $F_{hook}$ due to additional forces applied to the drill string 146 by the drill rig such as, for example, the combined weight of the traveling block 136, the top drive 140, and the sub saver 142 (referred to herein in as "$W_{top\text{-}drive}$"); an interface force ("$F_{rotary\text{-}hose}$") applied to the top drive 140 by the rotary hose 158, a load applied by the electrical drag chain; and a substantial intermittent load applied to the drill string 146 by the rotating seal 164 of the rotating control device 162 each time one of the tool joints 147 passes through the rotating seal 164 of the rotating control device 162 as described herein. In many implementations, the axial internal load in the drill string ($F_{top\text{-}of\text{-}borehole}$) can be calculated using equation (1) below.

$$F_{top-of-borehole} = F_{hook} + F_{seal} - W_{top-drive} - F_{rotary-hose} \quad \text{Equation (1)}$$

wherein: $F_{hook}$=vertical support load applied to the traveling block 136 by the hoisting system;

$F_{seal}$=vertical load intermittently applied to the drill string 146 by the rotating seal 164 during passage of each of the tool joints 147 through the rotating seal 164;

$W_{top\text{-}drive}$=combined weight of the traveling block 136, the top drive 140, and the sub saver 142; and $F_{rotary\text{-}hose}$=interface force applied to the top drive 140 by the rotary hose 158.

Figure 13C:
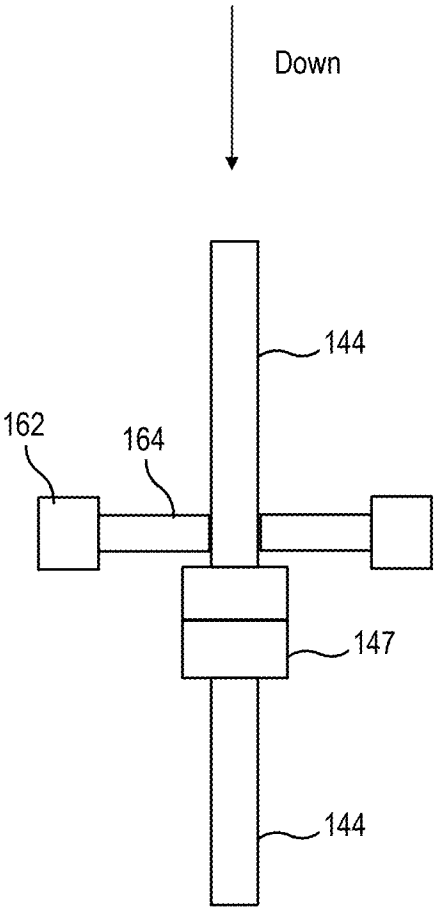
FIG. 13C illustrates a drill string tool joint after traveling through the rotating seal of the rotating control device of FIG. 13A.
Figure 13B:
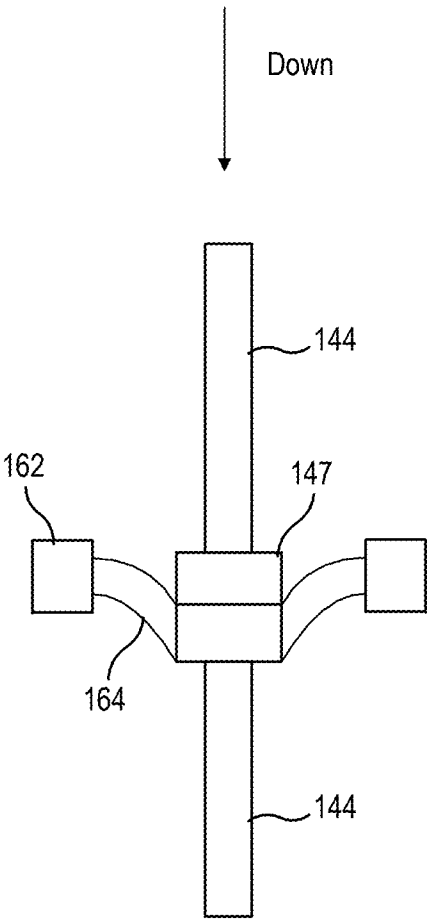
FIG. 13B illustrates a drill string tool joint engaged with the rotating seal of the rotating control device of FIG. 13A.
Figure 13A:
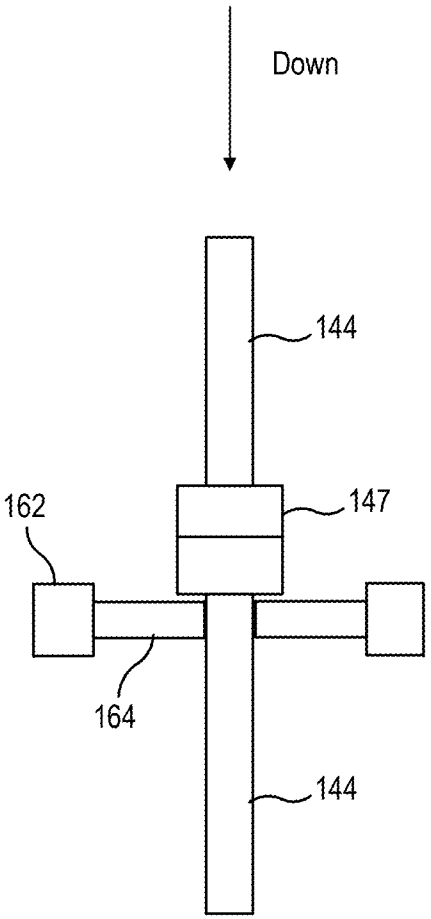
FIG. 13A illustrates a drill string tool joint approaching engagement with a rotating seal of a rotating control device.

Each passage of one of the tool joints 147 through the rotating seal 164 of the rotating control device 162 will typically result in a relatively large $F_{seal}$ so as to produce a substantial intermittent reduction in $F_{hook}$ as described herein. FIG. 13A, FIG. 13B, and FIG. 13C illustrate a downward passage of a tool joint 147 through the rotating seal 164 of the rotating control device 162. FIG. 13A shows a tool joint 147 positioned slightly above a height at which the tool joint 147 would engage or enter the rotating control device 162, which generally correlates to when the tool joint 147 would engage or enter the rotating seal 164. FIG. 13C shows the tool joint 147 just below a height at which the tool joint 147 would disengage or exit the rotating control device 162, which generally correlates to when the tool join 147 would disengage or exit the rotating seal 164. FIG. 13B shows the tool joint 147 engaged with the rotating seal 164 during passage therethrough. When a tool joint 147 is not passing through the rotating seal 164 (e.g., over a downward motion of the drill string 146 through the rotating seal 164 from the configuration shown in FIG. 13C until the next tool joint 147 reaches the rotating seal 164), the vertical force applied to the drill string 146 by the rotating seal 164 may be less than a threshold value which may correspond to determining the tool join 147 did not engage with the rotating seal, and therefore the compensated SWOB value may not be determined.

In various embodiments, $F_{seal}$ may be defined by an axial resistance force profile over a distance of engagement between the rotating seal 164 and the tool joints 147 based on measurements of the hook load ($F_{hook}$) from one or more wells. FIG. 13 shows a graph 1300 of SWOB (which does not account for the intermittent $F_{seal}$) for a range of traveling block positions from a collection of stands (e.g., stands 759, 761, 762, 765, 766, 767, 769, 777, 778, and 779) overlaid. The data in graph 1300 illustrates the SWOB includes large periodic fluctuations corresponding to the passage of tool joints 147 through the rotating seal 164. In the graph 1400, SWOB peaks occur at points 1302, 1304, and 1306, which correspond to the passage of the tool joints 147 through the rotating seal 164.

Figure 14:
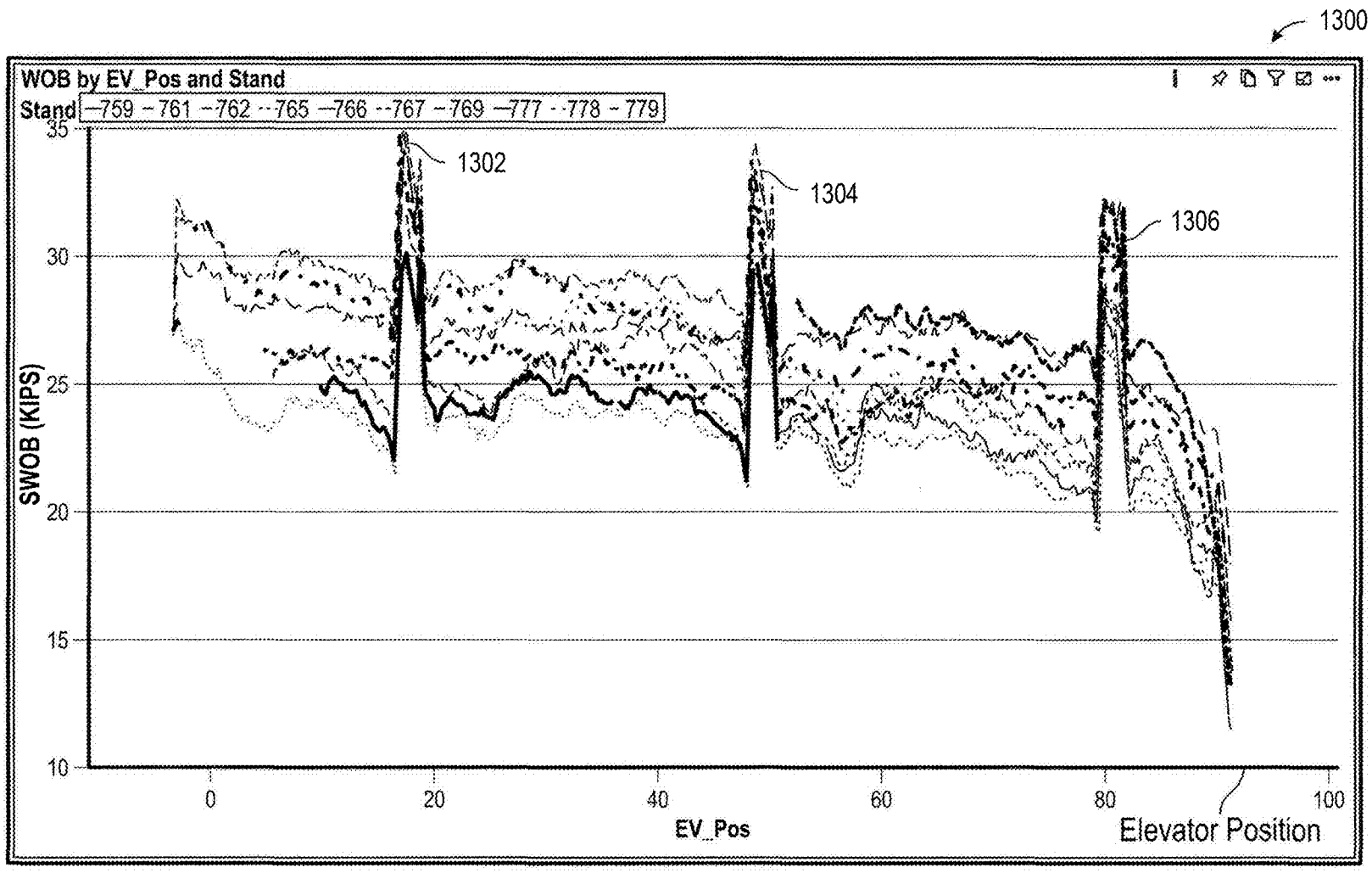
FIG. 14 shows plots of surface weight-on-bit for a range of elevator block position.

As can be seen in FIG. 14, the passage of each of the tool joints 147 through the rotating seal 164 produces a fairly consistent change in SWOB over applicable ranges of elevator position in which the rotating seal 164 is engaged by one of the tool joints 147. In some situations, such as indicated by graph 1300, the elevator positions for which the rotating seal 164 is engaged by one of the tool joints 147 may be consistent enough to use an open-loop solution, based on average force profile and calibration of elevator block position relative to the rotating seal 164, for use in determining the elevator positions for which $F_{seal}$ is accounted for. In some embodiments, $F_{seal}$ is formulated using $F_{hook}$ data from multiple drill rigs.

Figure 15:
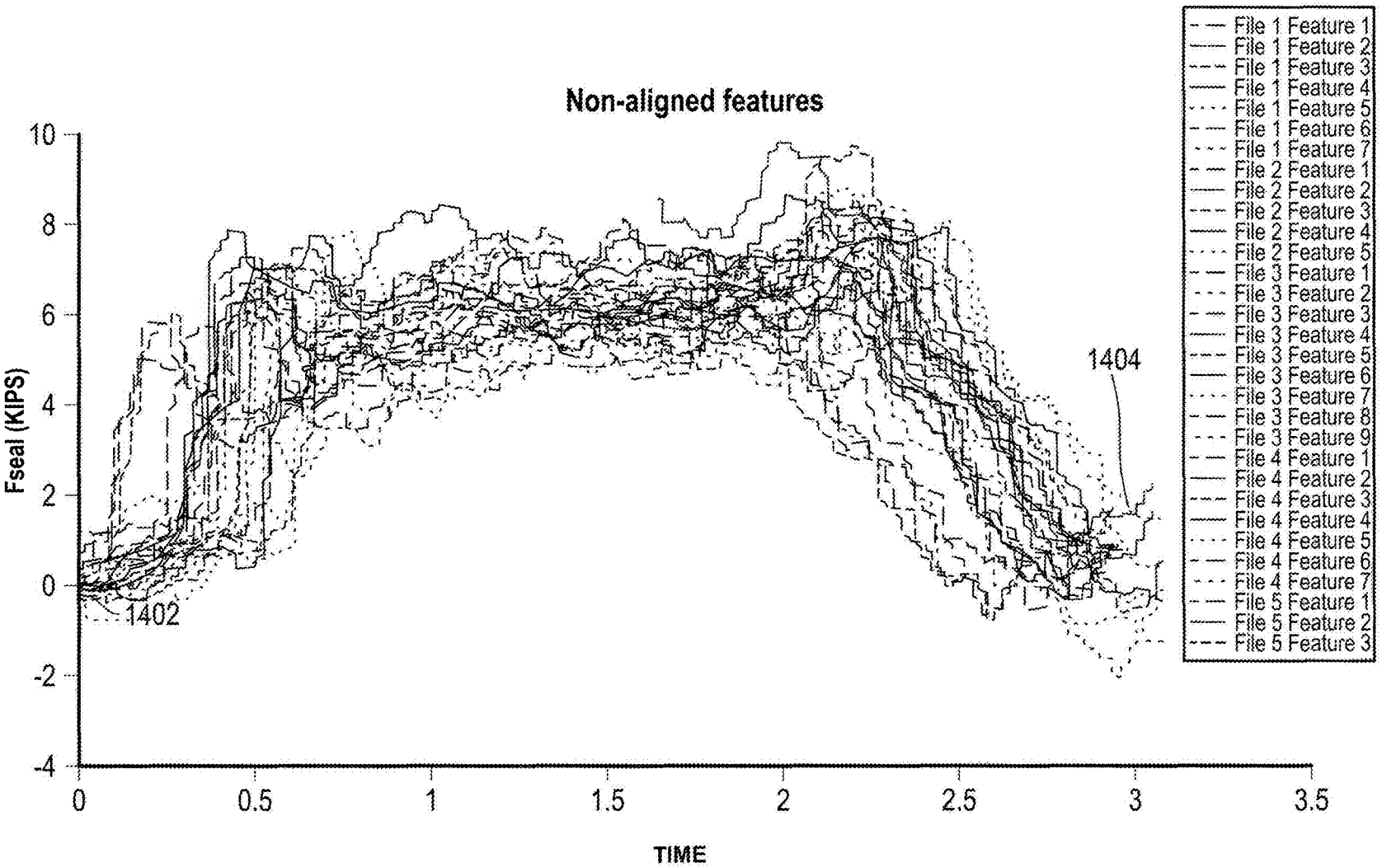
FIG. 15, FIG. 16, and FIG. 17 illustrates an approach for identifying an axial resistance force for a rotating seal induced load, in accordance with embodiments.
Figure 16:
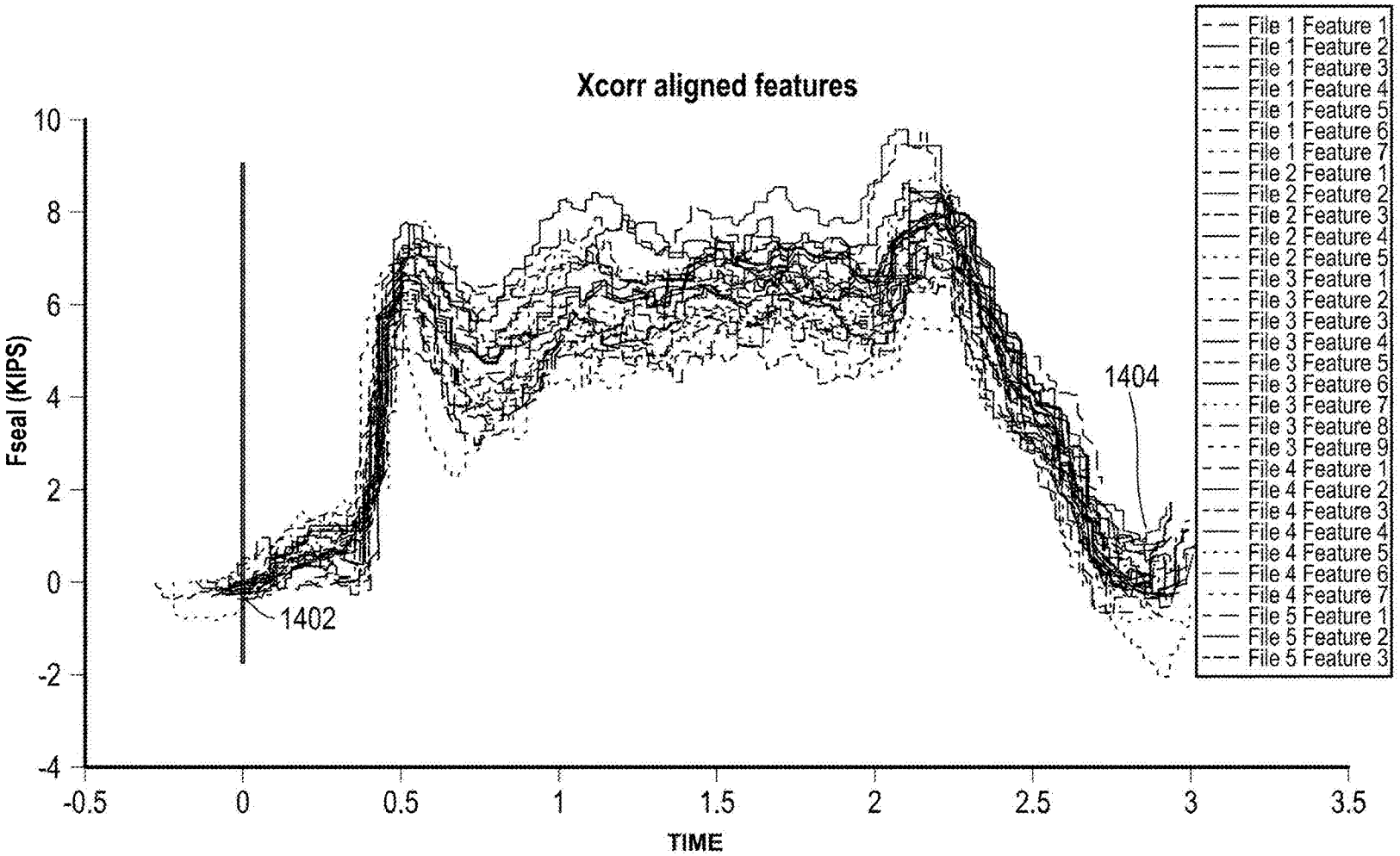
Figure 17:
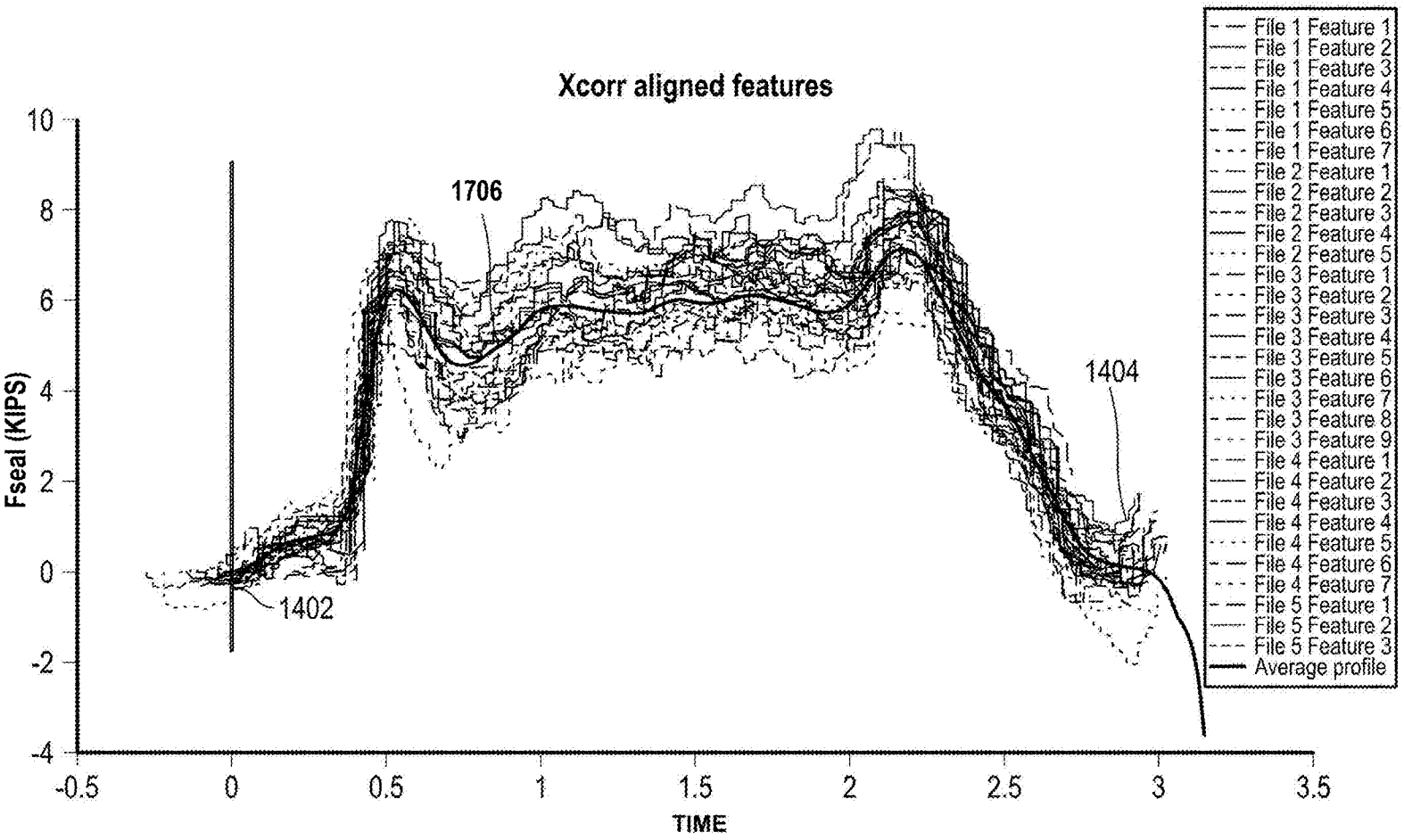

In some embodiments, $F_{seal}$ is approximated by an axial resistance force profile for $F_{seal}$ that spans a distance of engagement of the rotating seal 164 by each of the tool joints 147. FIG. 15, FIG. 16, and FIG. 17 illustrate an exemplary method for identifying an average force profile for $F_{seal}$. FIG. 15, FIG. 16, and FIG. 17 illustrate an axial resistance force profile for $F_{seal}$ that is depth indexed. The suitability of an axial resistance force profile for $F_{seal}$ depends on the uniformity of the geometry of the tool joints 147. For uniform tool joints 147, $F_{seal}$ is primarily dependent only on depth (related to the length of the tool joint 147 and the engaged length of the rotating seal 164). FIG. 15 illustrates $F_{seal}$ data from a plurality of exemplary wells. The data has been analyzed to identify and record a start index and an end index of exemplary passages of the tool joints 147 through the rotating seal 164. In FIG. 16, the $F_{seal}$ profiles are aligned using cross-correlation. FIG. 17 shows a smoothed axial resistance force profile for $F_{seal}$ 1706.

Any suitable approach can be used to determine an elevator position range for each of the tool joints 147 in the drill string over which the rotary seal 164 is engaged by the tool joint 147. For example, a machine vision system imaging device 1202 (shown in FIG. 12) can be used to generate image data corresponding to images of the drill string 146 passing through the rotating seal 164. The image data can be processed using a suitable image processing algorithm to detect when each of the tool joints 147 comes into contact with the rotating seal 147 to determine over which elevator positions to apply the average force profile for $F_{seal}$ to calculate the axial internal load in the drill string ($F_{top\text{-}of\text{-}borehole}$) using equation 1 and/or the compensated SWOB. Similarly, a computer vision system can be used to identify a pipe joint as the pipe joint moves through a field of vision of the computer vision system (such as by identifying its greater diameter than the rest of the pipe in the drill string), and can determine its velocity and/or location, and then use that determined velocity and/or location to determine when the pipe joint enters the RCD, and then send one or more signals to the drilling system to trigger the additional compensation adjustment to the WOB value used by the rig control systems. The drilling system may be a drilling system as disclosed herein. Examples of suitable computer vision systems and methods that may be used with the WOB compensation methods and systems described herein include U.S. Pat. No. 12,049,822 B1, issued on Jul. 30, 2024, titled "Systems and Methods for Oilfield Drilling Operations Using Computer Vision", as well as U.S. Pat. No. 11,971,247 B1, issued on Apr. 30, 2024, titled "Oil Rig Drill Pipe and Tubing Tally System," both of which are hereby incorporated by reference as if fully set forth herein. The computer vision systems and methods used with the drilling systems and methods described herein may use any of the systems and techniques (including the use of one or more cameras, one or more types of cameras used for image capture, the placement of one or more cameras, the field of view provided by the one or more cameras, the techniques used to process the image data from the one or more cameras, such as to identify the drill pipe, the diameter of the drill pipe and other equipment in the drill string, its location, movement, and velocity, and the like) described in either of U.S. Pat. No. 12,049,822 or U.S. Pat. No. 11,971,247 patents identified in this paragraph.

As another example, $F_{hook}$ can be monitored to detect a reduction in $F_{hook}$ indicative of a tool joint 147 coming into engagement with the rotating seal 164 to determine over which elevator positions to apply the average force profile for $F_{seal}$ to calculate the axial internal load in the drill string ($F_{top\text{-}of\text{-}borehole}$) using equation 1 and/or the compensated SWOB. As another example, $F_{hook}$ can be monitored in conjunction with ROP to detect a reduction in $F_{hook}$ combined with a lack of corresponding reduction in ROP, wherein the combination is indicative of a tool joint 147 coming into engagement with the rotating seal 164 to determine over which elevator positions to apply the average force profile for $F_{seal}$ to calculate the axial internal load in the drill string ($F_{top\text{-}of\text{-}borehole}$) using equation 1 and/or the compensated SWOB.

Figure 18:
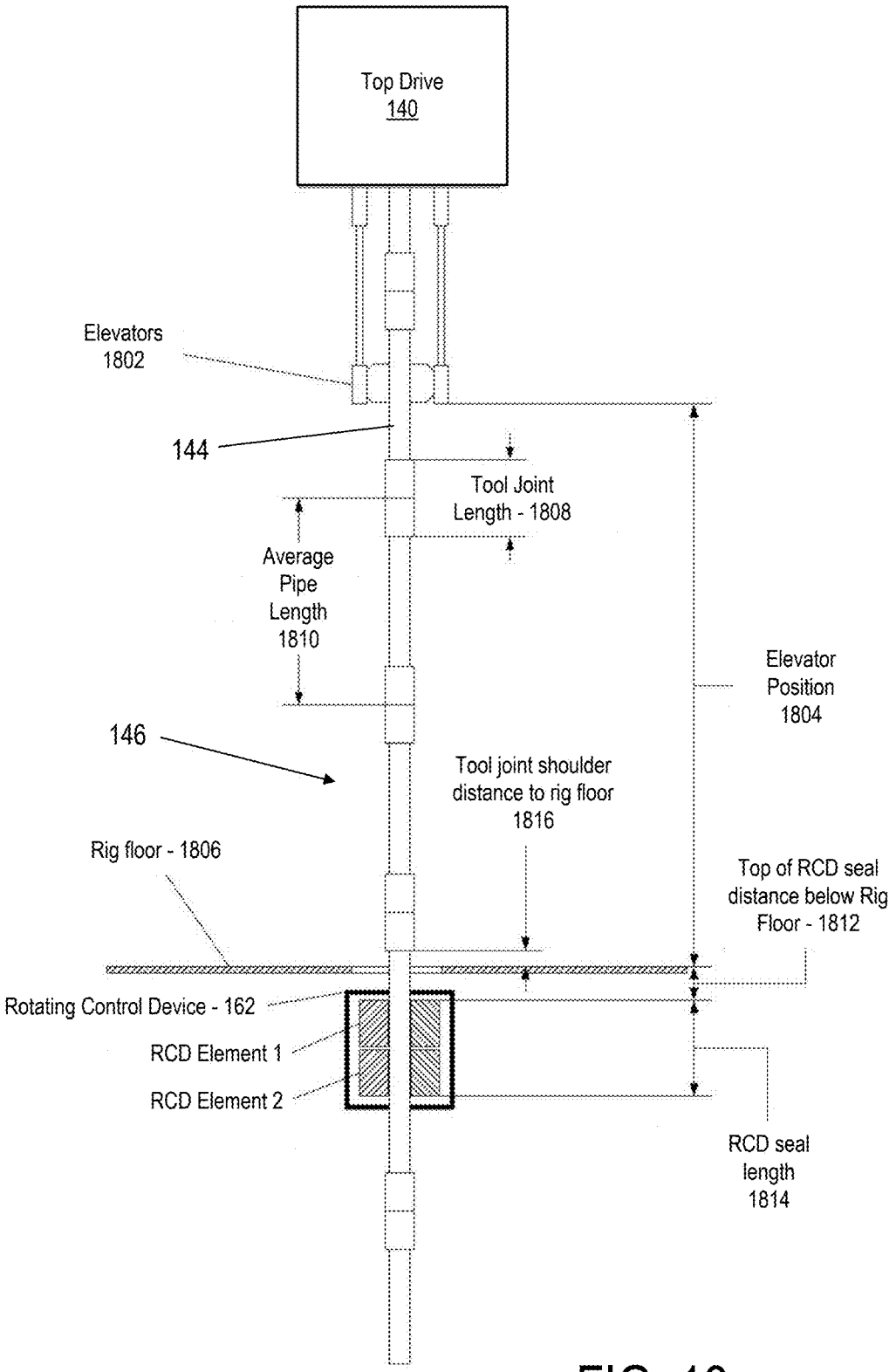
FIG. 18 and FIG. 19 illustrate dimensions and relative distances that can be used to track engagement of tool joints with a rotating control device for use in determining a compensated surface weight-on-bit and an axial internal load within a drill string, in accordance with embodiments.
Figure 19:
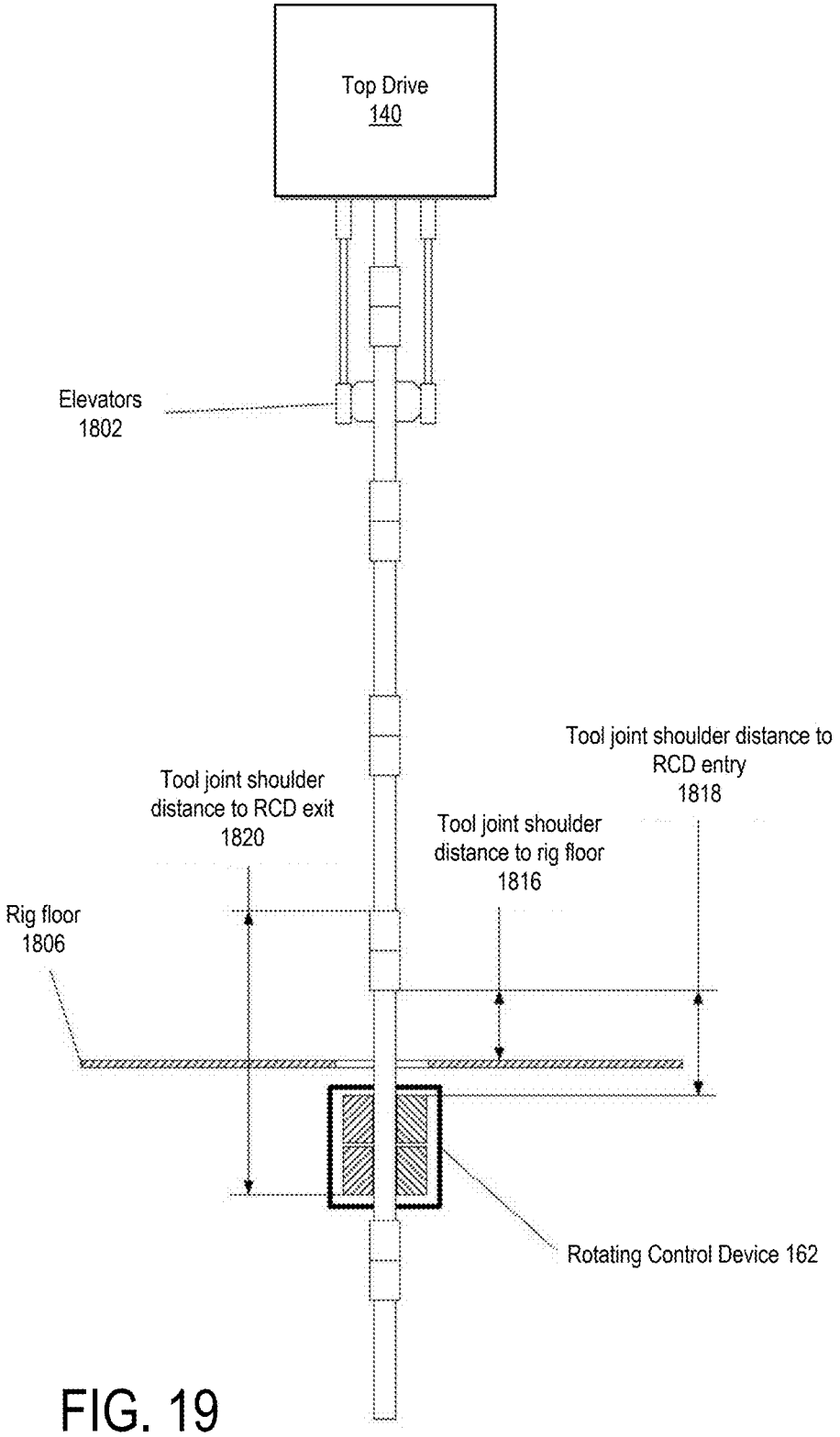

FIG. 18 and FIG. 19 illustrate dimensions and relative distances that can be used to track the position of the tool joints 147 relative to the rotating seal 164 of the rotating control device 162 for use in determining $F_{seal}$ for use in calculating the axial internal load in the drill string ($F_{top\text{-}of\text{-}borehole}$) and/or the compensated SWOB. Referring to FIG. 18, Elevators 1802 latched around a drill pipe 144 are used to raise and lower the drill string 146. An elevator position 1804 of the elevators 1802 relative to a rig floor 1806 can be tracked. Fixed distances that can be used to track the position of the tool joints 147 relative to the rotating seal 164 include a tool joint length 1808, an average pipe length 1810, a top of the RCD seal and the rig floor distance 1812, and an RCD seal length 1814. The distance between the elevators and the top of the RCD seal is equal to the elevator position 1804 added to the top of the RCD seal and the rig floor distance 1812. A tool shoulder joint to rig floor distance 1816 for each of the tool joints 147 can be calculated by subtracting a respective fixed offset distance from the elevator position 1804. The respective fixed offset distances between immediately adjacent instances of the tool joints 147 differ by the average pipe length 1810. A tool shoulder joint to RCD entry distance 1818 is equal to the tool shoulder joint to rig floor distance 1816 added to the top of the RCD seal and the rig floor distance 1812. A tool shoulder joint to RCD exit distance 1820 can be calculated by adding tool joint length 1808 to the tool shoulder joint to rig floor distance 1816. In some embodiments, the smoothed axial resistance force profile for $F_{seal}$ 1706 is used to determine $F_{seal}$ over engagement of each of the tool joints 147 with the RCD seal 164 from entry of the tool joint 147 into the RCD seal 164 to exit of the tool joint 127 from the RCD seal 164.

Weight-On-Bit (WOB) Calculation

In some embodiments, WOB is determined and monitored for use in controlling a drill rig during drilling operations to enhance efficiency and/or cost effectiveness of drilling of a borehole. In many instances, optimizing WOB may produce a desired balance of ROP, borehole track accuracy, and/or drill bit wear.

Figure 20:
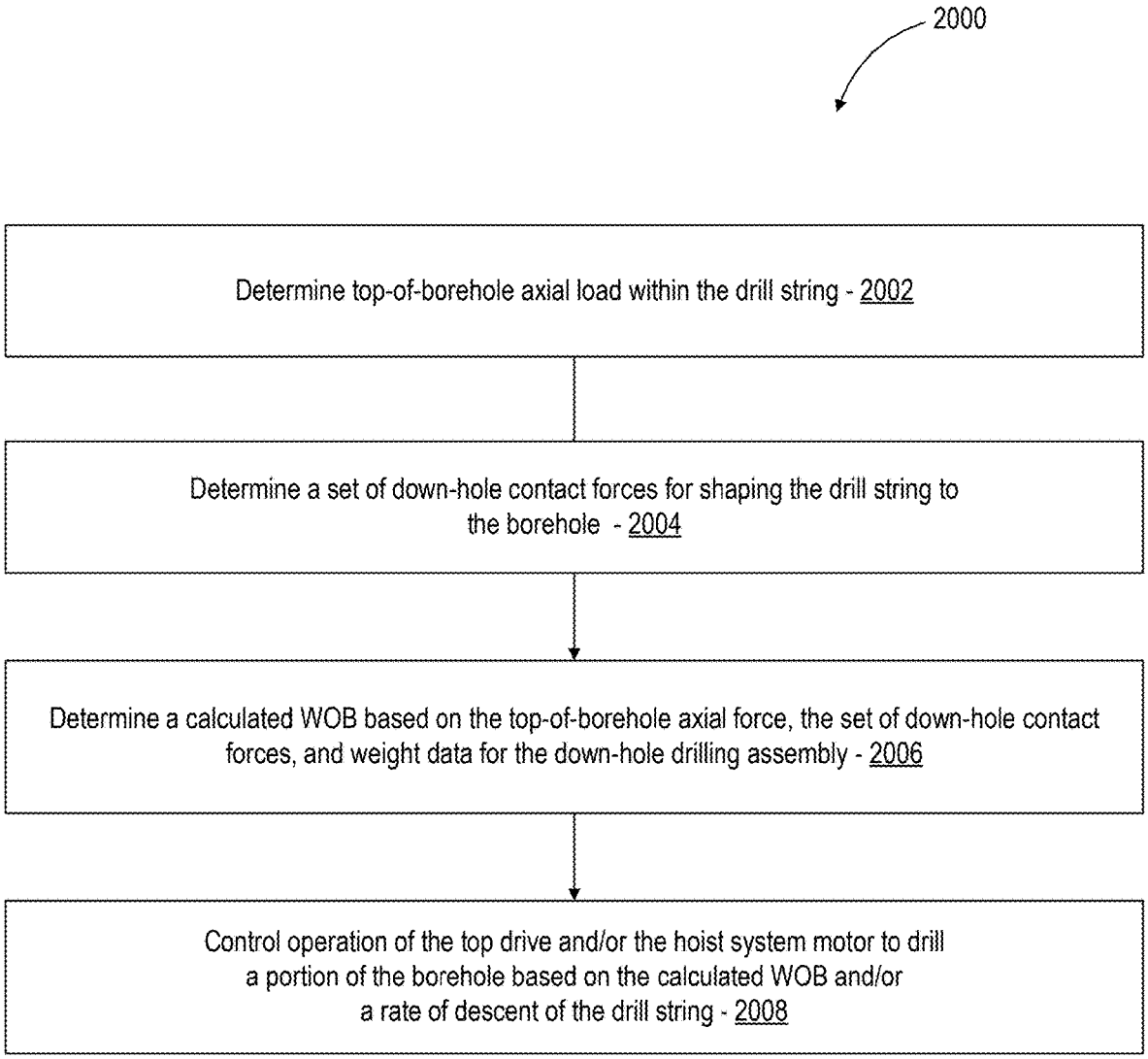
FIG. 20 shows a simplified schematic diagram illustrating a method of determining weight-on-bit (WOB) and controlling drilling based on WOB and/or a rate of descent of a drill string, in accordance with embodiments.

FIG. 20 shows a simplified schematic diagram illustrating a method 2000 of controlling drilling based on the calculated WOB and/or a rate of descent of a drill string, in accordance with embodiments. The method 2000 can be practiced in conjunction with any suitable drilling system, such as the drilling system 100.

At step 2002, the axial internal load in the drill string ($F_{top\text{-}of\ bore}$) is determined. The axial internal load in the drill string ($F_{top\text{-}of\ bore}$) can be determined as described herein.

Figure 21:
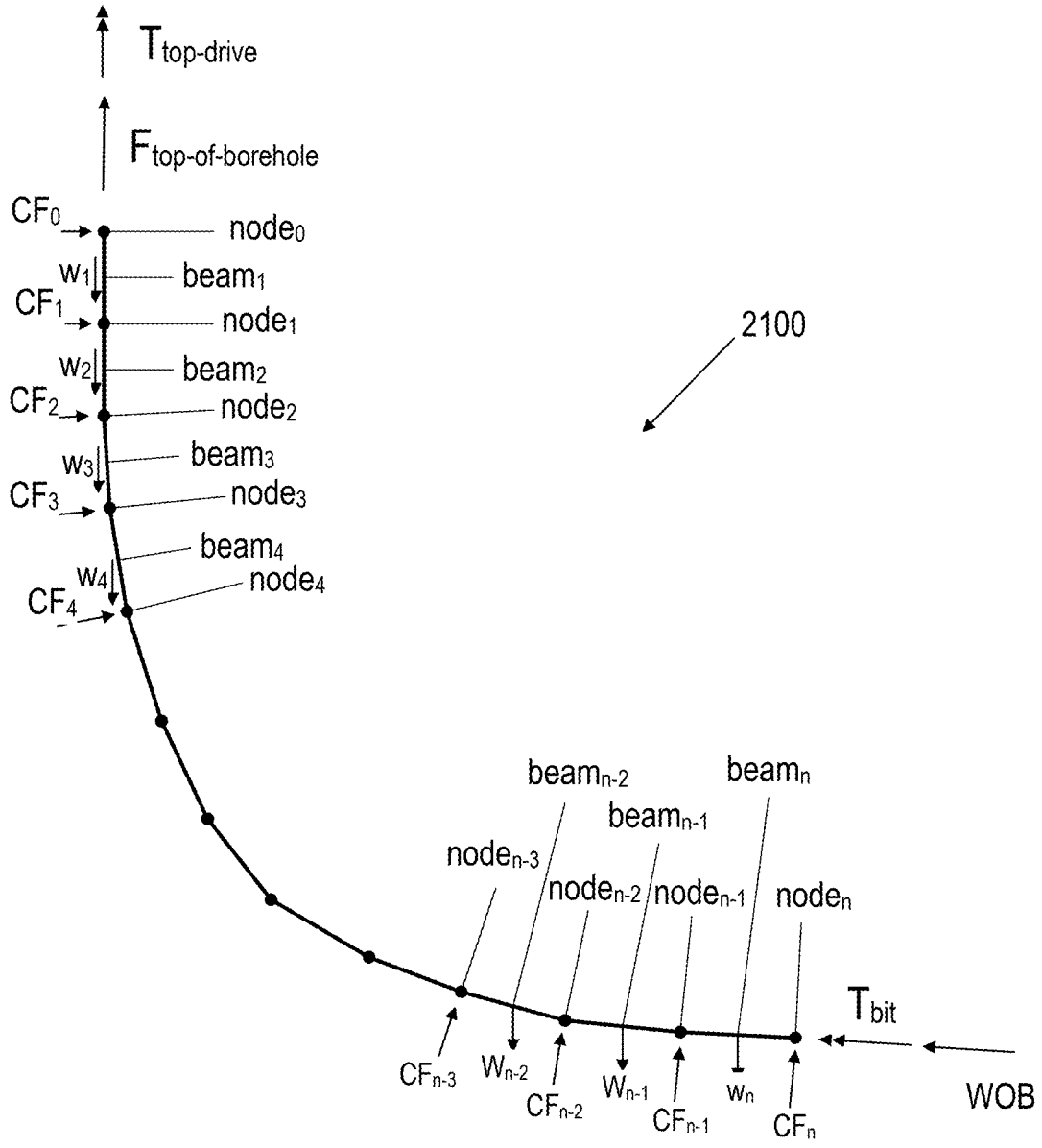
FIG. 21 illustrates a beam model of a drill string and bottom hole assembly of the drilling system of FIG. 1 that can be used to calculate down-hole forces, in accordance with embodiments.

At step 2004, a set of down-hole contact forces (applied to the drill string by the geological formation(s) through which the borehole extends) for deflecting the drill string 146 in conformance with the track of the borehole is determined. In some embodiments, a suitable model is used to calculate down-hole normal contact forces applied to the drill string and BHA (i.e., perpendicular to the bore hole trajectory) that can be used to calculate associated frictional forces, drill bit torsion, and WOB. For example, FIG. 21 illustrates a beam finite element model (FEM) 2100 of a drill string and BHA of the drilling system 100 that can be used to calculate the down-hole contact forces applied to the drill string and BHA. The beam FEM 2100 is constructed using beam element(1) through beam element(n) and node(0) through node(n). Node(0) corresponds to a point on the drill string 146 disposed at the top of the borehole. Node(n) corresponds to the first end of the BHA 149 (at the drill bit 148). The bore hole trajectory can be used to impose boundary conditions on each of node(1) through node (n) to conform the deflected shape of the beam elements (1 through n) to the bore hole trajectory. The imposed boundary constraints can be configured to ensure that each of the determined normal contact forces (CF(0) through CF(n)) is oriented perpendicular to the bore hole trajectory at the respective node. The determined contact forces can be used, in conjunction with dimensions of the down-hole assembly to determine an associated friction force for each of the determined contact forces. The normal contact forces, friction forces, beam segment weights (w(1) through w(n)), the axial internal load in the drill string ($F_{top\text{-}of\text{-}borehole}$), and top drive torque ("$T_{top\text{-}drive}$") can be used to calculate WOB and drilling bit torsion ($T_{bit}$) using static equilibrium equations (i.e., summation of force equations, summation of moment equations).

The drilling system and methods described herein can also be employed in conjunction with many operational modes (e.g., autodriller system on or off, without an autodriller system, with autoslide system on or off, without an autoslide system, etc.). For example, no setpoint adjustment may be needed for other systems (autoslide, autodriller, DAS, etc.). The compensated SWOB and/or the determined axial internal load in the drill string below the RCD also provides a better insight into actual downhole WOB. Increased accuracy for WOB measurement can improve drilling efficiency and thereby lower costs associated with drilling a wellbore. For example, the compensated SWOB provides an improved surrogate for WOB over an uncompensated SWOB. Moreover, the compensated SWOB described herein may be employed without having to make any setpoint adjustment in other systems such as an autoslide, autodriller, or DAS system to account for the force applied to the drill string by the RCD when a tool joint passes through the RCD. The disclosed drilling system and methods can be implemented universally around the fleet and can more accurately reflect the environment (e.g. forces) downhole at the bit. In addition, the compensated WOB provides a more accurate surrogate for WOB for use by the WOB controller. In other words, the disclosed systems and methods herein provide for improved accuracy of SWOB measurements by compensating for the force as a tool joint passes through the RCD at the same step where other forces, such as the weight of the drag chains, the mud hose, etc. are determined and others are used to calculate SWOB, thereby preventing the need to add an additional separate step to account for the passing of the tool joint through the RCD, for example but not limited to by altering the set point of the SWOB during drilling when the tool joint passes through the RCD.

Those skilled in the art should appreciate that the foregoing description of compensating the WOB value as a pipe joint passes through the RCD has focused on drilling a wellbore and increasing the length of the drill string as the wellbore is drilled. While this description focuses on compensating for the effects of the RCD on WOB during drilling, those skilled in the art should note that the foregoing systems and methods may be used to advantage when tripping out; i.e., when some or all of the drill string is removed from the wellbore. Although rate of penetration is not necessarily a concern during such tripping out operations, control of the drill string and its removal from the wellbore at a controlled rate may be a safety concern. In such operations, the WOB value used by the drilling rig control systems may be compensated for the resistive force on the drill string pipe joint by at least the lower seal of the RCD as the pipe joint engages with the lower seal and passes through the RCD in an upward direction. In some embodiments, a compensated SWOB may not be calculated and/or utilized by one or more systems of the drilling rig once the pipe joint has passed the upper seal of the RCD and is therefore above the RCD. In addition, as described above with respect to drilling of the wellbore, the WOB measurements and/or the use of a compensated SWOB measurement may be tracked and utilized to determine the length of the drill string that has been tripped out and/or remains downhole.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A drilling system comprising:

one or more sensors configured to generate sensor output indicative of a hook load applied to a drill string by a hoisting system; and a computer system coupled to the one or more sensors and configured to:

monitor the hook load;

track movement of the drill string relative to a rotating control device (RCD), wherein the drill string comprises drill pipes and tool joints, wherein each of the tool joints connects two of the drill pipes;

determine a compensated surface weight-on-bit (SWOB) that accounts for passage of the tool joints through the RCD, wherein the compensated SWOB is based on a difference between a weight of the drill string and the hook load minus an axial resistance force on the drill string when a tool joint passes through the RCD; and drilling a wellbore, using the compensated SWOB, as the tool joint passes through the RCD;

repeatedly determine an uncompensated SWOB based on a difference between a weight of the drill string and the hook load;

generate uncompensated SWOB data indicative of the uncompensated SWOB over a drilling time span; and process the uncompensated SWOB data to determine RCD passage data indicative of variations in the uncompensated SWOB induced by passage of the tool joints through the RCD; and process the RCD passage data to calculate a running average axial resistance force from a running average of the RCD passage data for the passage of two or more of the tool joints through the RCD, wherein the axial resistance force is at least partially based on RCD passage data, and the running average axial resistance force.

2. The drilling system of claim 1, wherein operation of the hoisting system is controlled by the computer system further based on a rate of descent of the drill string.

3. The drilling system of claim 2, wherein operation of the hoisting system is controlled by the computer system further based on a limit for the rate of descent of the drill string.

4. The drilling system of claim 1, wherein the axial resistance force is based on measured variations in the uncompensated SWOB during passage of prior tool joints through one or more rotating control devices.

5. The drilling system of claim 1, wherein the computer system is configured to:

process the uncompensated SWOB data to track a number of the drill pipes that are downhole; and determine the weight of the drill string based on the number of the drill pipes that are downhole.

6. The drilling system of claim 1, wherein the computer system is configured to process image data produced by a machine-vision imaging device to determine when the tool joint is entering the RCD and/or exiting the RCD.

7. The drilling system of claim 1, wherein the computer system is configured to:

monitor a rate of descent of the drill string; and detect an engagement of the rotating control device by the tool joint based on the rate of descent of the drill string and a detected variation in the hook load.

8. The drilling system of claim 1, wherein the computer system is configured to:

determine a set of down-hole contact forces for producing a deflected shape of the drill string that conforms to a track of a borehole in which the drill string is disposed;

determine weight-on-bit (WOB) based on the compensated SWOB and the set of down-hole contact forces; and control operation of a top drive and/or the hoisting system to drill a portion of the borehole based on the WOB and/or a rate of descent of the drill string.

9. The drilling system of claim 8, wherein:

the drill string comprises a bottom hole assembly (BHA) that comprises one or more BHA sensors configured to generate BHA sensor output indicative of position and orientation of the BHA; and the computer system is configured to process the BHA sensor output to determine the track of the borehole.

10. The drilling system of claim 8, wherein the computer system is configured to calculate down-hole friction forces applied to the drill string based on the set of down-hole contact forces.

11. The drilling system of claim 1, wherein the computer system is configured to:

store a first tool joint configuration axial resistance force for a first tool joint configuration of the tool joints;

store a second tool joint configuration axial resistance force for a second tool joint configuration of the tool joints;

set the axial resistance force equal to the first tool joint configuration axial resistance force for determining the compensated SWOB when the tool joint passing through the RCD has the first tool joint configuration; and set the axial resistance force equal to the second tool joint configuration axial resistance force for determining the compensated SWOB when the tool joint passing through the RCD has the second tool joint configuration.

12. The drilling system of claim 11, wherein the computer system is configured to process image data produced by a machine-vision imaging device to determine whether the tool joint passing through the RCD has the first tool joint configuration or the second tool joint configuration.

13. The drilling system of claim 1, wherein the compensated SWOB further accounts for one or more of a combined weight of a traveling block and a top drive, forces applied by drag chains, drill pipe buoyancy effects, or forces applied by a drilling mud hose.

14. A method of drilling a borehole, the method comprising:

generating, by one or more sensors, sensor output indicative of a hook load applied to a drill string located in a borehole being drilled;

processing, by a computer system, the sensor output to monitor the hook load;

tracking, by the computer system, movement of the drill string relative to a rotating control device (RCD), wherein the drill string comprises a plurality of drill pipes and tool joints, wherein each of the tool joints connects two of the drill pipes;

determining, by the computer system, a compensated SWOB that accounts for passage of a tool joint through the RCD, wherein the compensated SWOB is based on a difference between a weight of the drill string and the hook load minus a force defined by an axial resistance force during passage of the tool joint through the RCD;

controlling, by the computer system, operation of a top drive and a hoisting system to drill the borehole, wherein operation of the hoisting system is controlled using the compensated SWOB;

repeatedly determining, by the computer system, an uncompensated SWOB based on a difference between a weight of the drill string and the hook load;

generating, by the computer system, SWOB data indicative of the SWOB over a drilling time span; and processing, by the computer system, the SWOB data to determine RCD passage data indicative of variations in the SWOB induced by passage of the tool joints through the RCD, wherein the axial resistance force is at least partially based on the RCD passage data;

processing, by the computer system, the RCD passage data to calculate a running average axial resistance force from a running average of the RCD passage data for the passage of two or more of the tool joints through the RCD, and wherein the axial resistance force is at least partially based on the running average axial resistance force; and drilling the borehole, using the compensated SWOB, as the tool joint passes through the RCD.

15. The method of claim 14, wherein operation of the hoisting system is controlled by the computer system further based on a rate of descent of the drill string.

16. The method of claim 14, further comprising determining the axial resistance force is based on measured variations in the uncompensated SWOB during passage of prior tool joints through one or more rotating control devices and the location of a first surface of the tool joint relative to a first end of the RCD.

17. The method of claim 14, further comprising:

processing, by the computer system, the SWOB data to track a number of the drill pipes that are downhole; and determining, by the computer system, the weight of the drill string based on the number of the drill pipes that are downhole.

18. The method of claim 14, further comprising processing, by the computer system, image data produced by a machine-vision imaging device to determine when the tool joint is entering the RCD and/or exiting the RCD.

19. The method of claim 14, further comprising:

monitoring, by the computer system, a rate of descent of the drill string; and detecting, by the computer system, an engagement of the rotating control device by the tool joint based on the rate of descent of the drill string and a detected variation in the hook load.

20. The method of claim 14, further comprising:

determining, by the computer system, a set of down-hole contact forces for producing a deflected shape of the drill string that conforms to a track of the borehole in which the drill string is disposed;

determining, by the computer system, weight-on-bit (WOB) based on the compensated SWOB and the set of down-hole contact forces; and controlling, by the computer system, operation of the top drive and/or the hoisting system to drill a portion of the borehole based on the WOB and/or a rate of descent of the drill string.

21. The method of claim 20, wherein the drill string comprises a bottom hole assembly (BHA) that comprises one or more BHA sensors configured to generate BHA sensor output indicative of position and orientation of the BHA, and further comprising processing the BHA sensor output by the computer system to determine the track of the borehole.

22. The method of claim 20, further comprising calculating, by the computer system, down-hole friction forces applied to the drill string based on the set of down-hole contact forces.

23. The method of claim 14, further comprising:

storing, by the computer system, a first tool joint configuration axial resistance force for a first tool joint configuration of the tool joints;

storing, by the computer system, a second tool joint configuration axial resistance force for a second tool joint configuration of the tool joints;

setting, by the computer system, the axial resistance force equal to the first tool joint configuration axial resistance force for determining the compensated SWOB when the tool joint passing through the RCD has the first tool joint configuration; and setting, by the computer system, the axial resistance force equal to the second tool joint configuration axial resistance force for determining the compensated SWOB when the tool joint passing through the RCD has the second tool joint configuration.

24. The method of claim 23, further comprising processing, by the computer system, image data produced by a machine-vision imaging device to determine whether the tool joint passing through the RCD has the first tool joint configuration or the second tool joint configuration.

25. A drilling system comprising:

one or more sensors configured to generate sensor output indicative of a hook load applied to a drill string by a hoisting system; and a computer system coupled to the one or more sensors and configured to:

monitor the hook load;

track movement of the drill string relative to a rotating control device (RCD), wherein the drill string comprises drill pipes and tool joints, wherein each of the tool joints connects two of the drill pipes;

determine a compensated surface weight-on-bit (SWOB) that accounts for passage of the tool joints through the RCD, wherein the compensated SWOB is based on a difference between a weight of the drill string and the hook load minus an axial resistance force on the drill string when a tool joint passes through the RCD;

store a first tool joint configuration axial resistance force for a first tool joint configuration of the tool joints;

store a second tool joint configuration axial resistance force for a second tool joint configuration of the tool joints;

set the axial resistance force equal to the first tool joint configuration axial resistance force for determining the compensated SWOB when the tool joint passing through the RCD has the first tool joint configuration;

set the axial resistance force equal to the second tool joint configuration axial resistance force for determining the compensated SWOB when the tool joint passing through the RCD has the second tool joint configuration; and drilling a wellbore, using the compensated SWOB, as the tool joint passes through the RCD.

26. The drilling system of claim 25, wherein the computer system is configured to process image data produced by a machine-vision imaging device to determine whether the tool joint passing through the RCD has the first tool joint configuration or the second tool joint configuration.

27. The drilling system of claim 25, wherein the compensated SWOB further accounts for one or more of a combined weight of a traveling block and a top drive, forces applied by drag chains, drill pipe buoyancy effects, or forces applied by a drilling mud hose.

28. The drilling system of claim 25, wherein operation of the hoisting system is controlled by the computer system further based on a rate of descent of the drill string.

29. The drilling system of claim 28, wherein operation of the hoisting system is controlled by the computer system further based on a limit for the rate of descent of the drill string.

30. The drilling system of claim 25, wherein the axial resistance force is based on measured variations in an uncompensated SWOB during passage of prior tool joints through one or more rotating control devices.

* * * * *